US010274240B2

(12) United States Patent
Ji et al.

(10) Patent No.: US 10,274,240 B2
(45) Date of Patent: Apr. 30, 2019

(54) ICE MAKER AND REFRIGERATOR HAVING SAME

(71) Applicant: DAECHANG CO., LTD., Jeollabuk-do (KR)

(72) Inventors: Jun Dong Ji, Gyeonggi-do (KR); Jung Woo Lee, Seoul (KR)

(73) Assignee: DAECHANG CO., LTD., Jeollabuk-Do (KR)

( * ) Notice: Subject to any disclaimer, the term of this patent is extended or adjusted under 35 U.S.C. 154(b) by 175 days.

(21) Appl. No.: 15/112,185

(22) PCT Filed: Oct. 16, 2014

(86) PCT No.: PCT/KR2014/009703
§ 371 (c)(1),
(2) Date: Jul. 17, 2016

(87) PCT Pub. No.: WO2015/194706
PCT Pub. Date: Dec. 23, 2015

(65) Prior Publication Data

US 2017/0321943 A1 Nov. 9, 2017

(30) Foreign Application Priority Data

Apr. 7, 2014 (KR) ..... 10-2014-0083983
Apr. 7, 2014 (KR) ..... 10-2014-0083984
(Continued)

(51) Int. Cl.
*F25C 1/24* (2018.01)
*F25C 5/08* (2006.01)
(Continued)

(52) U.S. Cl.
CPC ..... *F25C 1/24* (2013.01); *F25C 1/04* (2013.01); *F25C 5/08* (2013.01); *F25C 2700/06* (2013.01); *F25C 2700/12* (2013.01); *F25D 11/00* (2013.01)

(58) Field of Classification Search
CPC .... F25C 1/24; F25C 2400/10; F25C 2600/04; F25C 2700/12
See application file for complete search history.

(56) References Cited

U.S. PATENT DOCUMENTS

2005/0066670 A1* 3/2005 Chung ..... F25C 1/04 62/137
2011/0048045 A1* 3/2011 An ..... F25C 1/04 62/137

FOREIGN PATENT DOCUMENTS

JP 2005-188913 A 7/2005
KR 10-2007-0094587 A 9/2007
(Continued)

OTHER PUBLICATIONS

International Search Report for PCT/KR2014/009703.

*Primary Examiner* — Marc E Norman
(74) *Attorney, Agent, or Firm* — The PL Law Group, PLLC

(57) ABSTRACT

An ice maker includes an ice tray with partitioned spaces for receiving ice-making water, an ejector for ice-separating an ice in the ice tray, a detector unit for detecting at least one of a position of the ejector and a temperature of the ice tray, a control box provided to be opposite to the ice tray and including a printed circuit board and a motor for driving the ejector therein, and a planar heater provided in the ice tray and including a heating element of a metal thin film and an insulating member to wrap the heating element such that the
(Continued)

planar heater is pressured by virtue of an instrument provided in the ice tray to be bonded to or in closely contacted with the ice tray.

18 Claims, 31 Drawing Sheets

(30) Foreign Application Priority Data

| | | |
|---|---|---|
| Jun. 20, 2014 | (KR) | 10-2014-0075847 |
| Jul. 22, 2014 | (KR) | 10-2014-0092344 |
| Oct. 15, 2014 | (KR) | 10-2014-0138809 |

(51) Int. Cl.
*F25C 1/04* (2018.01)
*F25D 11/00* (2006.01)

(56) References Cited

FOREIGN PATENT DOCUMENTS

| | | | |
|---|---|---|---|
| KR | 10-0781261 | B1 | 11/2007 |
| KR | 10-0814686 | B1 | 3/2008 |
| KR | 10-2010-0116147 | A | 10/2010 |
| KR | 10-2014-0067592 | A | 6/2014 |

* cited by examiner (a)

(b)

(a)

(b)

(a)

(b)

(a)

(b)

(a)

(b)

ICE MAKER AND REFRIGERATOR HAVING SAME

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/009703, filed on Oct. 16, 2014, which claims priority to the benefit of Korean Patent Application No. 10-2014-0075847 filed on Jun. 20, 2014, 10-2014-0083984 filed on Jul. 4, 2014, 10-2014-0083983 filed on Jul. 4, 2014, 10-2014-0092344 filed on Jul. 22, 2014, and 10-2014-0138809 filed on Oct. 15, 2014 in the Korean Intellectual Property Office, the entire contents of which are incorporated herein by reference.

TECHNICAL FIELD

The present disclosure relates to an ice maker, and in more detail, to an ice maker having a planar heater and a refrigerator having same.

BACKGROUND ART

Generally, a refrigerator includes a refrigerating chamber for storing foods in a fresh state and a freezing chamber for storing foods in a frozen state. In this case, the freezing chamber or the refrigerating chamber is provided with an ice maker for making ice.

FIG. 1 is a bottom view showing a conventional ice maker for a refrigerator.

Referring to FIG. 1, the ice maker 10 includes a heater 27 provided on the lower surface of the ice tray 11. When the ice-making is completed, the heater 27 serves to allow the ice to be ice-separated by lightly melting the ice tightly coupled with the inner surface of the ice tray 11. For the heater 27, a U-shaped sheath heater may be mainly used.

Here, since the heater 27 may be in line-contacted and formed in the form of a U-shape in the lower portion of the ice tray 11, an area in directly contacted with the ice tray 11 is smaller and thus, the heat transfer efficiency can be decreased. In order to melt ice within the ice tray 11 by transmitting heat to a portion which is not directly contacted with the heater 27, a lot of time and power consumption are required. In this case, since the ice tray is excessively heated by the heater 27, in ice-making cycles after the ice is separated, time required for the ice tray 11 to be again cooled by an ice-making temperature takes a lot of time. Accordingly, there is a problem in that the ice-making time becomes long. In addition, in a conventional sheath heater, connections between the sheath heater and a thermal fuse for cutting off power when the sheath heater is over-heated are complicated and a connecting structure for supplying power to the sheath heater is complicated. Thus, there is a problem in that assembly and connection between the corresponding components is difficult in the conventional sheath heater.

SUMMARY

An embodiment of the present disclosure provides an ice maker to increase heat transfer efficiency from a heater to an ice tray and a refrigerator having the same.

An embodiment of the present disclosure provides an ice maker and a refrigerator having the same, wherein and the ice-making time can be shortened while reducing power consumption required to a whole of ice-making process.

In accordance with an embodiment of the present disclosure, there is provided an ice maker which includes: an ice tray configured to have partitioned spaces receiving ice-making water; an ejector configured to ice-separate an ice within the ice tray; a detector unit configured to detect at least one of a position of the ejector and a temperature of the ice tray; a control box configured to be provided opposite to the ice tray and include a printed circuit board and a motor for driving the ejector therein; and a planar heater configured to be provided at the ice tray and include a heating element of a metal thin film and an insulating member wrapping the heating element such that the planar heater is pressured by an instrument provided at the ice tray to be in closely contacted with the ice tray, or be bonded to and in closely contacted with the ice tray.

In accordance with another embodiment of the present disclosure, there is provided an ice maker which includes: an ice tray configured to have partitioned spaces receiving ice-making water; an ejector configured to ice-separate an ice within the ice tray; a detector unit configured to detect at least one of a position of the ejector and a temperature of the ice tray; a control box configured to be provided opposite to the ice tray and include a printed circuit board and a motor for driving the ejector therein; and a planar heater configured to be provided at the ice tray and include a heating element of a metal thin film and an insulating member wrapping the heating element, and a power connecting unit electrically connected to the heating element and made of a substrate in which an electrode pad is provided on one surface of the substrate. In the embodiment, one end of the power connecting unit protrudes from the ice tray toward the control box, and the planar heater is pressured by an instrument provided at the ice tray to be in closely contacted with the ice tray, or be bonded to and in closely contacted with the ice tray.

In accordance with further another embodiment of the present disclosure, there is provided an ice maker which comprises: an ice tray configured to have partitioned spaces receiving ice-making water; an ejector configured to ice-separate an ice within the ice tray; a detector unit configured to detect at least one of a position of the ejector and a temperature of the ice tray; a control box configured to be provided opposite to the ice tray and include a printed circuit board and a motor for driving the ejector therein; and a planar heater configured to be provided at the ice tray and include a heating element of a metal thin film and an insulating member wrapping the heating element. In the embodiment, one surface of the planar heater is primarily in closely contacted with the ice tray by being bonded to the ice tray and the other surface of the planar heater is pressured by an instrument so that the planar heater is secondarily in closely contacted with the ice tray by being pressured by an instrument.

In the embodiment, the one surface of the planar heater may be provided opposite to the ice tray. In addition, the ice maker may include a heater pressuring unit by which the planar heater is in closely contacted with the ice tray by pressuring the other surface of the planar heater.

In the embodiment, the heater pressuring unit may be extended from a guide unit provided on one side portion of the ice tray or a heater cover provided on the lower portion of the ice tray toward the ice tray side to pressure the planar heater.

In the embodiment, the planar heater may include a first planar heater provided on one side of the outer circumferential surface of the ice tray and a second planar heater provided on the other side of the outer circumferential surfaces of the ice tray. In the embodiment, the ice maker may further include a heater cover provided on the lower portion of the ice tray, and the heater pressuring unit may be extended from both ends toward the outer side of the heater cover respectively to pressure the first planar heater and the second planar heater.

In the embodiment, the heater pressuring unit may include at least one pressuring protrusion which protrudes toward the planar heater side to pressure the other surface of the planar heater.

In the embodiment, the heating element and one side of the insulating member may be in closely contacted with the ice tray at a power connecting unit of the planar heater, and the one end of the heating element may be electrically connected to an electrode pad formed on the power connecting unit.

In the embodiment, the planar heater may be provided such that portions corresponding to at least one of one end of the ice tray, the other end of the ice tray and a center portion of the ice tray may be formed to have a higher heating density than the other portions.

In the embodiment, the planar heater may be provided to be biased to one side of the ice tray on the outer circumferential surface on the basis of a center of the ice tray, and the printed circuit board of the control box may be provided to be biased to a side corresponding to the planar heater on the basis of the center of the control box.

In accordance with an embodiment of the present disclosure, there is provided an ice maker which includes: an ice tray configured to have partitioned spaces receiving ice-making water; an ejector configured to ice-separate an ice within the ice tray; a planar heater configured to be provided at the ice tray and include a power connecting unit having a heating element, an insulating member wrapping the heating element, and a support plate made of any one of a PCB (Printed Circuit Board), a metal PCB and plastic; and a control box configured to be provided opposite to the ice tray and include a motor for driving the ejector therein, a connector to which the power connecting unit is inserted and connected, and a printed circuit board formed with the connector.

In accordance with an embodiment of the present disclosure, there is provided an ice maker which includes: an ice tray with configured to have partitioned spaces receiving ice-making water; an ejector configured to ice-separate an ice within the ice tray; a planar heater configured to be provided at the ice tray and include a heating element of a metal thin film, an insulating member wrapping the heating element, and a power connecting unit electrically connected to the heating element, in which an electrode pad is provided on one surface of the substrate and one end protrudes from the ice tray; and a control box configured to be provided opposite to the ice tray and include a motor for driving the ejector therein, a connector to which the protruded one end of the power connecting unit is inserted and connected, and a printed circuit board formed with the connector for supplying power to the planar heater.

In the embodiment, the ice maker may further include a heater receiving unit, wherein the heater receiving unit is provided on the outer circumferential surface of the ice tray along the longitudinal direction of the ice tray from one end of the ice tray to the other end of the ice tray and the planar heater is received. In addition, one side of the power connecting unit electrically connected to the heating element of the planar heater may be received in the heater receiving unit and the other side of the power connecting unit connected to the connector protrudes toward the control box.

In the embodiment, the ice maker may include a lead cable electrically connecting the heating element and the printed circuit board. In addition, the planar heater may be provided at the ice tray and connected with the heating element and the lead cable. Furthermore, the ice maker may further include a power cut-off unit cutting off the power applied to the heating element of the planar heater under a predetermined condition.

In the embodiment, the power connecting unit may be provided to be insert-injected into a molding unit.

In the embodiment, the control box may include a through-hole on a surface opposite to the ice tray, into which one end of the power connecting unit is inserted. In the embodiment, the ice maker may further includes a packing member sealing the through-hole between the control box and the power connecting unit.

In the embodiment, the ice tray may include first tray formed of a metal sheet or a resin and a second tray formed of a metal sheet or a resin, and the first tray and the second tray are coupled with each other to be superimposed.

In the embodiment, the planar heater may be provided between the first tray and the second tray.

In the embodiment, the ice maker may further include a heater connected to the planar heater in parallel and mounted into a component spaced from the ice maker.

In the embodiment, the first tray may be provided on the inner side of the second tray, the second tray may be made of a resin, and the planar heater may be mounted on the second tray.

In the embodiment, the heating element of the planar heater may be made of a thin metal plate having a thickness of more than 0 and less than 20 μm, and the outer surface of the heating element may be provided with an insulating film.

In the embodiment, the insulating member of the planar heater may be a polyimide or a PET (Polyethylene phthalate).

In the embodiment, the planar heater may be is a PTC (Positive Temperature Coefficient) heater.

According to the embodiments of the present disclosure, since a planar heater may be provided to be in surface-contacted with an outer circumferential surface of an ice tray, a wider area contacted with the ice tray can be obtained. Thus, heat transfer efficiency from the planar heater to the ice tray can be increased, and the ice frozen on the inner side of the ice tray can be melt even with small quantity of heat and a short operating time. In addition, since an insulating member is provided on the other surface of the planar heater, a loss of heat leaking to the outer side of the ice tray can be prevented.

In addition, since the planar heater may be in closely contacted with the ice tray through an adhesive member or a heater pressuring unit, heat efficiency transferred from the planar heater to the ice tray can be increased.

In addition, since the planar heater may be made in the form of a thin type to reduce heat capacity of the planar heater, a temperature of the planar heater can be increased to a predetermined temperature in a short time and the power consumption used in the planar heater can be reduced.

In addition, since operations of a first planar heater and a second planar heater can be controlled depending on a rotating position of an ejector or lapsed operation time of the ejector, the power consumption required to melt the ice frozen on the inner circumferential surface of the ice tray can be reduced.

In addition, since the planar heater may be provided in the form of a modular type to include a power connecting unit made of a PCB or metal PCB, a power cut-off unit and a temperature sensor or the like can be formed on a power connecting unit through a simple structure and circuit.

In addition, since the power connecting unit of the planar heater may be connected to a connector provided within the control box, a power supply connecting structure can be simplified and the power connecting unit of the planar heater can be easily connected (that is, an one-touch connection is possible) or disconnected.

In addition, since the planar heater may be provided to be biased to one side of the ice tray on the basis of the center of the ice tray, a structure of a printed circuit board within a control box can be simplified, and a power cut-off unit and a temperature sensor or the like can be electrically connected to the planar heater and mounted to be adjacent to each other into the ice tray at the same time.

BEST MODE DETAILED DESCRIPTION

Hereinafter, referring FIGS. 2 to 31, the specific embodiments of an ice maker and a refrigerator having the same according to the present disclosure will be described. However, the embodiments are merely illustrated and are no intent to limit the present disclosure to the particular forms disclosed.

In the following description of the present disclosure, the detail description with regard to a well-known technology related to the present disclosure will be omitted when determined to unnecessarily obscure the subject matter of the present disclosure. In addition, the terms described herein are the terms defined in consideration of functions in the present disclosure and can vary according to the custom or intention of users or operators. Therefore, the definitions should be made according to the features throughout the present specification.

The technical features of the present disclosure may be determined by claims, the following embodiments are merely a means for efficiently describing progressive spirit of the present disclosure to a person of ordinary skill in the art.

Figure 1:
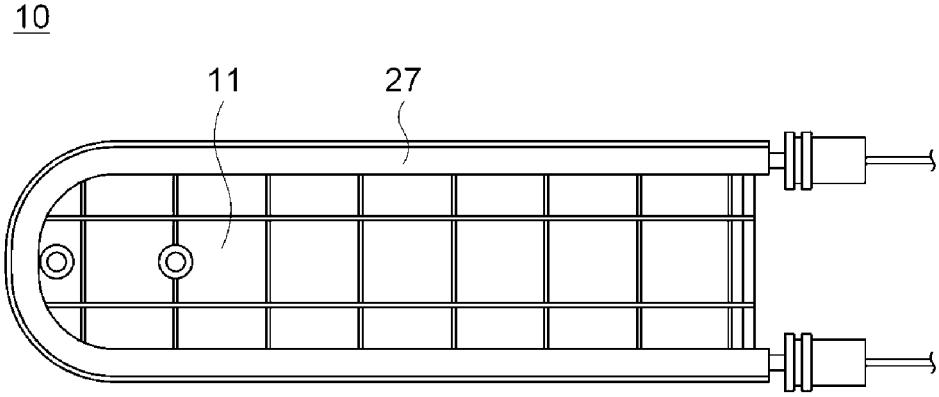
FIG. 1 is a bottom view showing an ice maker for the conventional refrigerator.
Figure 2:
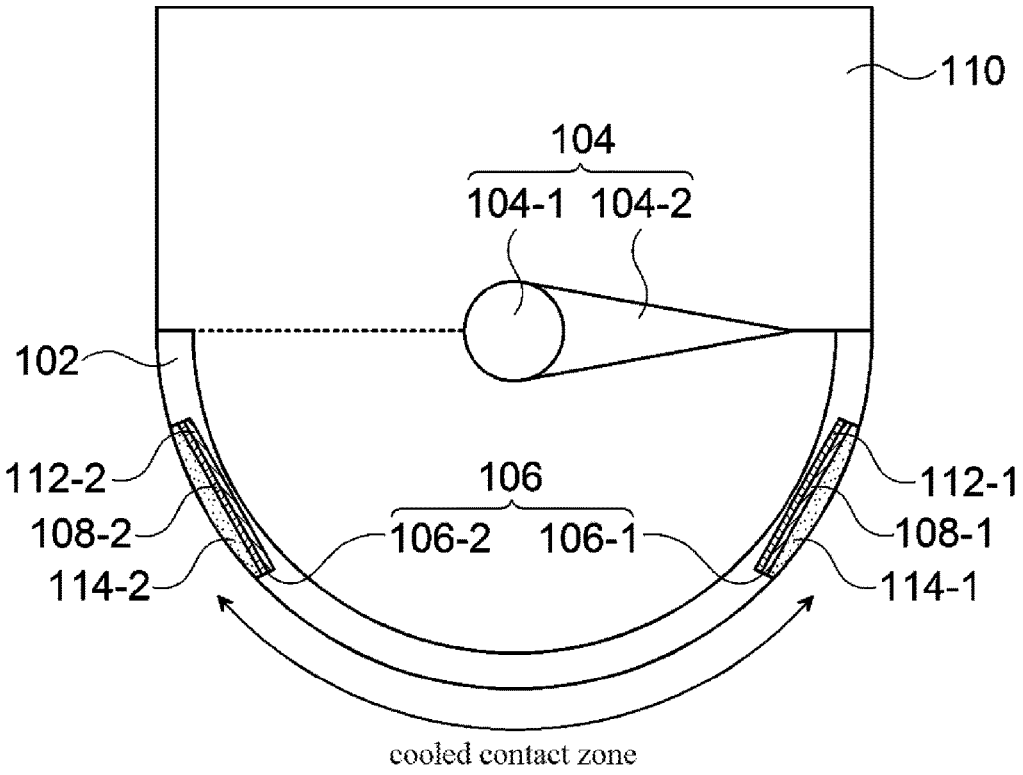
FIG. 2 is a cross-sectional view showing an ice maker according to one embodiment of the present disclosure.
Figure 3:
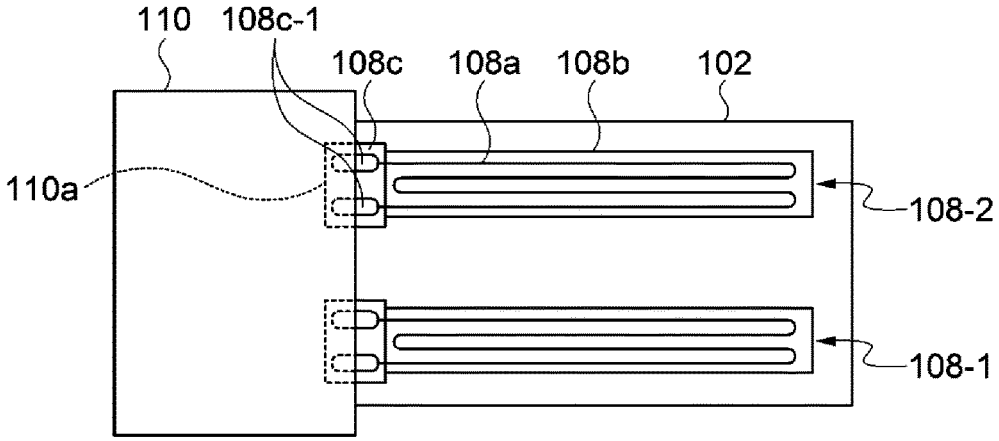
FIG. 3 is a bottom view showing an ice maker according to one embodiment of the present disclosure.

FIG. 2 is a cross-sectional view illustrating an ice maker according to an embodiment of the present disclosure, and FIG. 3 is a bottom view illustrating the ice maker according to the embodiment of the present disclosure.

Referring to FIGS. 2 and 3, the ice maker 100 includes an ice tray 102, an ejector 104, a heater receiving unit 106, a planar heater 108 and a control box 110.

The ice tray 102 has an ice-making space for receiving water therein. The ice tray 102 is formed with a plurality of partitions therein so that the ice-making space can be separated into a plurality of spaces. In this case, each ice-making space separated in the ice tray 102 can be formed to be corresponded to an ejector pin 104-2. The inner circumferential surface of the ice tray 102 may be provided in a semicircular arc shape having a radius corresponding to the length of the ejector pin 104-2 by rotating the ejector pin 104-2 to allow the ice to be ice-separated.

The ejector 104 serves to allow the ice in the ice tray 102 to be ice-separated. The ejector 104 includes an ejector shaft 104-1 connected to a motor (not shown) in the control box 108 and a plurality of ejector pins 104-2 formed to be spaced apart from each other in the ejector shaft 104-1. The ejector pin 104-2 can be rotated in a predetermined direction around the ejector shaft 104-1 (for example, clockwise in FIG. 2) to allow the ice in the ice tray 102 to be ice-separated.

The heater receiving unit 106 may be provided on the outer circumferential surface of the ice tray 102. The heater receiving unit 106 is a part equipped with a planar heater 108. The heater receiving unit 106 may be provided in the form of a receiving groove on the outer circumferential surface of the ice tray 102. In this case, the surface equipped with the planar heater 108 in the heater receiving unit 106 (that is, the bottom surface of the receiving groove) may be provided in a plane.

In other words, the outer circumferential surface of the ice tray 102 is provided in the shape of the curve corresponding to the inner circumferential surface of the ice tray 102. However, when the surface of the curved shape is equipped with the planar heater 108, since the heating element of the planar heater 108 can be damaged, by forming the surface equipped with the planar heater 108 in the heater receiving unit 106 in a plane, the damage of the heating element of the planar heater 108 can be prevented.

The heater receiving unit 106 may include a first heater receiving unit 106-1 provided on one side of the outer circumferential surface of the ice tray 102 and a second heater receiving unit 106-2 provided on the other side of the outer circumferential surface of the ice tray 102. Here, the one side of the outer circumferential surface of the ice tray 102 refers to a side corresponding to a groove position (that is, starting position) of the ejector pin 104-2, and the other side of the outer circumferential surface of the ice tray 102 refers to a side located in the direction opposite to the one side.

The planar heater 108 may be provided at the heater receiving unit 106. In this case, the planar heater 108 is provided to be in surface-contacted with the outer circumferential surface of the ice tray 102. The planar heater 108 may be provided along the longitudinal direction of the ice tray 102. The planar heater 108 may generate the heat over a predetermined area. The planar heater 108 may be made in the form of a thin type. For example, the planar heater 108 may have a thickness of more than 0 and less than 1 mm. The lower limit of the thickness of the planar heater 108 can be properly set on the level of those skilled in the art depending on materials of the heating element and the insulating member constituting the planar heater 108. By producing the planar heater 108 in the form of a thin type reducing the heat capacity of the planar heater 108, the planar heater 108 can be raised to a predetermined temperature in a short time. In this case, the power consumption used for the planar heater 108 can be reduced. For example, the planar heater 108 may be, but is not limited to, a PTC (Positive Temperature Coefficient) heater.

The planar heater 108 may include a heating element **108*a*, an insulating member 108*b* and a power connecting unit 108*c*. The heating element 108*a* may be provided over the entire area of the planar heater 108 to generate heat. For example, the heating element 108*a* may be provided in a zig-zag form over the entire area of the planar heater 108. For the heating element 108*a*, a metal thin film may be used. However, this configuration is not intended to be taken as limited to. For example, a stainless thin film, a platinum thin film, a tungsten film, a nickel thin film and the like may be used. The heating element 108*a* may be formed by coating a thin film of a CNT (Carbon Nano Tube), a carbon-nano plate and the like. The heating element 108*a* may have a thickness of more than 0 and less than 0.5 mm. The lower limit of the thickness of the heating element 108*a*** can be properly set on the level of those skilled in the art depending on material of the heating element.

The insulating member **108*b* may be provided to wrap the heating element 108*a*. The insulating member 108*b* may be made of a polyimide or a grapheme material. In this case, the heating element 108*a* can be reliably protected even if the heating element 108*a* is raised to a high temperature or applied by an external impact. However, the insulating member 108*b* is not intended to be taken as limited to these materials. For example, it may be made of a variety of insulating materials other than these materials. The insulating member 108*b* may be formed of a film form. The insulating member 108*b* may include a first insulating member provided to wrap the heating element 108*a* from one surface of the heating element 108*a* and a second insulating member provided to wrap the heating element 108*a* from the other surface of the heating element 108*a***.

The power connecting unit **108*c* may be provided to the end of the planar heater 108. The power connecting unit 108*c* may be made of a PCB (Printed Circuit Board) or a metal PCB. The power connecting unit 108*c* may be formed with an electrode pad 108*c*-1 to which both end of the heating element 108*a* is electrically connected. A part of the electrode pad 108*c*-1 to which the heating element 108*a* is connected at the power connecting unit 108*c* may be formed with an insulating member (not shown) while wrapping the electrode pad 108*c*-1. The power connecting unit 108*c* may be connected to a connector 110*a* provided within the control box 110. In this case, the electrode pad 108*c*-1 of the power connecting unit 108*c* can be electrically connected to the connector 110*a*. The power connecting unit 108*c* is electrically connected to a power supply unit (not shown) through the connector 110*a*, and serves to apply the power delivered from a power supply (not shown) to the heating element 108*a*. The power supply unit (not shown) may be provided within the control box 110, but is not limited to. Alternatively, the power supply unit (not shown) may be provided on other parts of the refrigerator equipped with the ice maker 100** (for example, a control unit of the refrigerator control unit).

The planar heater 108 may be adhered to and in closely contacted with the ice tray 102 within the heater receiving unit 106. The planar heater 108 may include a first planar heater 108-1 received and mounted in the first heater receiving unit 106-1 and a second planar heater 108-2 received and mounted in the second heater receiving unit 106-2. A first adhesive member 112-1 is provided on one surface of the first planar heater 108-1 (that is, the surface opposite to the ice tray 102). The first planar heater 108-1 may be in closely contacted with the outer circumferential surface of the ice tray 102 through the first adhesive member 112-1. A second adhesive member 112-2 is provided on one surface of the second planar heater 108-2 (that is, the surface opposite to the ice tray 102. The second planar heater 108-2 may be in closely contacted with the outer circumferential surface of the ice tray 102 through the second adhesive member 112-2.

For the first adhesive member 112-1 and the second adhesive member 112-2, polyimide adhesives may be used, but are not limited thereto. For example, adhesive pastes containing thermal conductive powder may be used for the first adhesive member 112-1 and the second adhesive member 112-2 as well. In this case, the first planar heater 108-1 and the second planar heater 108-2 can be adhered to the ice tray 102, and the heat generated in the first planar heater 108-1 and the second planar heater 108-2 can be efficiently delivered to the ice tray 102.

A first heat insulating member 114-1 and a second heat insulating member 114-2 may be provided on the other surfaces of first planar heater 108-1 and the second planar heater 108-2, respectively. The first heat insulating member 114-1 and the second heat insulating member 114-2 serve to prevent the heat generated from the first planar heater 108-1 and the second planar heater 108-2 from exiting to the outside of the ice tray 102, respectively. In this case, the heat generated from the first planar heater 108-1 and the second planar heater 108-2 can increase the heat transfer efficiency delivered to the inside of the ice tray 102. The surfaces of the first heat insulating member 114-1 and the second heat insulating member 114-2 can be made of the outer circumferential surface of the ice tray 102.

Herein, since the first planar heater 108-1 and the second planar heater 108-2 can be in surface-contacted with the ice tray 102, a wider area contacted with the ice tray 102 can be obtained. In this case, since the heat transfer efficiency from the ice tray 102 to the first planar heater 108-1 and the second planar heater 108-2 can be increased, the ice frozen on the inner side of the ice tray 102 can be melt even with small quantity of heat and a short operating time.

In addition, the first planar heater 108-1 and the second planar heater 108-2 can be provided on the both sides of the outer circumferential surface of the ice tray 102 and the first heat insulating member 114-1 and the second heat insulating member 114-2 can be provided on the another surfaces of the first planar heater 108-1 and the second planar heater 108-2, whereby the heat can be quickly delivered to the total inner area of the ice tray 102 through the first planar heater 108-1 and the second planar heater 108-2.

Meanwhile, a cooled air contact zone may be provided on the bottom portion of the outer circumferential surface of the ice tray 102. In other words, an area between the first planar heater 108-1 and the second planar heater 108-2 in the outer circumferential surface of the ice tray 102 can be exposed to the outside. The cooled air contact zone is an area in which the ice tray 102 is in contacted with the cooled air within the ice-making chamber, and the temperature of the ice tray 102 serves to be reached at an ice-making temperature in a short time.

In other words, if the ice tray 102 is heated by the first planar heater 108-1 and the second planar heater 108-2 and a frozen ice on the inner circumferential surface of the ice tray 102 is then gently melt, the ejector 104 rotates and the ice is ice-separated into an ice bank (not shown). Then, by supplying the ice-making water into the ice tray 102, the ice-making process is performed again. In this case, the area contacted with the cooled air within the ice-making chamber is secured by the ice tray through the cooled air contact zone, and the temperature of the ice tray 102 is reached at the ice-making temperature in a short time, whereby the entire ice-making time can be shorten.

The control box 110 may be provided on the one side of the ice tray 102. The control box 110 may be coupled with the ice tray 102 at the one side of the ice tray 102. The control box 110 may be provided with a control unit (not shown) which controls the entire operation of the ice maker 100. In addition, the control box 110 may be provided with an ice-separating motor (not shown) to rotate the ejector 104 in a predetermined direction. The control box 110 may be provided with a power supply unit (not shown) to supply power to the ice-separating motor (not shown) and the planar heater 108.

Herein, the control unit (not shown) can control on or off operations of the first planar heater 108-1 and the second planar heater 108-2, for example, depending on the rotational position of the ejector 104 or the lapsed operation time of the ejector 104. Specifically, the control unit (not shown) may be configured such that the first planar heater 108-1 and the second planar heater 108-2 is operated when a temperature of the ice tray 102 is arrived at a pre-determined ice-making temperature (that is, a temperature at which the ice-making water in the ice tray 102 is completely ice-made).

Next, the control unit (not shown) is configured such that the ejector 104 rotates in the clockwise direction in FIG. 2 to start ice-separation in the ice tray 102. The control unit (not shown) may be configured such that the first planar heater 108-1 is turned off when the position of the ejector 104 is passed through the first planar heater 108-1 (that is, the ejector 104 entered the cooled air contact zone). In this case, the power consumption required to melt the ice can be reduced. At this time, the control unit (not shown) can determine a current position of the ejector 104 (that is, a rotated position of the ejector pin 104-2), by accumulating and operating the numbers of the pulse signals input from an ice-separating motor (not shown) after determining a groove position of the ejector 104 through a position sensor (not shown)

Here, it is described that the first planar heater 108-1 is turned off by the control unit (not shown) when the ejector 104 is passed through the first planar heater 108-1 after the first planar heater 108-1 and second planar heater 108-2 are all turned on (ON), but is not limited thereto. For example, operations of the first planar heater 108-1 and the second planar heater 108-2 may be controlled by a variety of ways.

For example, the control unit (not shown) may be configured such that when the temperature of the ice tray 102 is arrived at a pre-determined ice-making temperature, only the first planar heater 108-1 can be operated, and when ejector 104 is passed through the first planar heater 108-1, the first planar heater 108-1 can be turned off and the second planar heater 108-2 can be turned on at the same time. In addition, when the ejector 104 is passed through the first planar heater 108-1, the first planar heater 108-1 is turned off. In addition, before the ejector 104 is passed through the second planar heater 108-2 (that is, when the ejector 104 is located at the cooled air contact zone), the second planar heater 108-2 can be turned-on.

In addition, the control unit (not shown) may control the first planar heater 108-1 and the second planar heater 108-2 depending on the position of the ejector 104, but is not limited thereto. For example, the control unit (not shown) may also control the first planar heater 108-1 and the second planar heater 108-2 depending on the lapsed time after the ejector 104 rotates.

Meanwhile, the adhesive member 112 may be provided on the one surface of the planar heater 108 and the heat insulating member 114 may be provided on the other surface of the planar heater 108, but is not limited thereto. For example, an insulating film may be in closely contacted with the other surface of the planar heater 108. In addition, a contact member may be provided on the other surface of the planar heater 108 wherein the contact member has at least one of a cushion function, heat conduction capability, a heat-resistant function, and an insulating function.

According to an embodiment of the present disclosure, since the planar heater 108 is in surface-contacted with the outer circumferential surface of the ice tray 102, the wider area contacted with the ice tray 102 can be obtained, and thus, the heat transfer efficiency from the planar heater 108 to the ice tray 102 can be increased, and the ice frozen on the inner side of the ice tray 102 can be melt even with small quantity of heat and a short operating time. In addition, the heat insulating member 114 is provided on the other surface of the planar heater 108 and thus, a loss of heat leaking to the outer side of the ice tray 102 can be prevented. In addition, by producing the planar heater 108 in the form of a thin type and reducing the heat capacity of the planar heater 108, the temperature of the planar heater 108 can be increased to a predetermined temperature in a short time, and the power consumption used in the planar heater 108 can be reduced. In addition, by controlling the operations of the first planar heater 108-1 and the second planar heater 108-2 depending on the rotating position of the ejector 104 or the lapsed operation time of the ejector 104, the power consumption required to melt the ice frozen on the inner circumferential surface of the ice tray 102 can be reduced.

Figure 4:
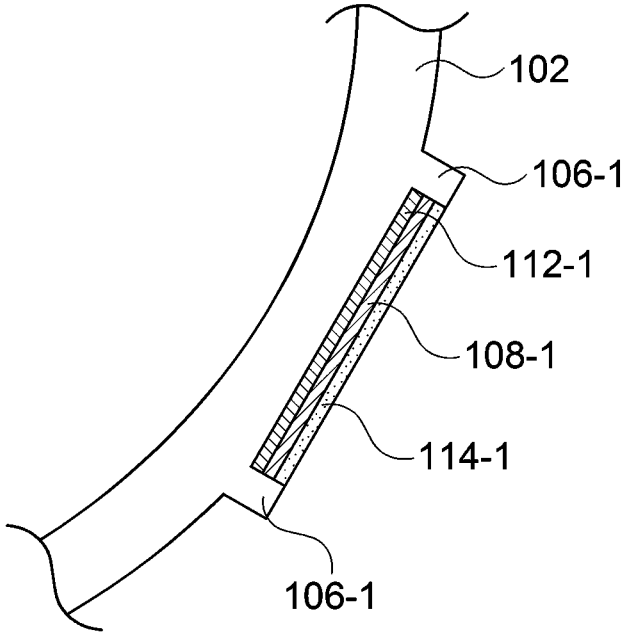
FIG. 4 is a view showing another embodiment of a heater receiving unit, in the ice maker according to an embodiment of the present disclosure.

FIG. 4 is a view showing another embodiment of a heater receiving unit, in the ice maker according to an embodiment of the present disclosure. Here, it is shown that the first heater receiving unit 106-1 is provided on one side of the outer circumferential surfaces of the ice tray 102.

Referring to FIG. 4, the first heater receiving unit 106-1 may be made of a receiving protrusion unit protruded and provided on the outer circumferential surface of the ice tray 102. In this case, the first heater receiving unit 106-1 may be provided to have a size and shape corresponding to the first planar heater 108-1 such that the both side of the first planar heater 108-1 may be mounded into the inner wall of the first heater receiving unit 106-1. In the outer circumferential surfaces of the ice tray 102, a surface on which the first planar heater 108-1 is mounted may be formed of a flat surface. In this case, a surface on which the first planar heater 108-1 is mounted may be provided obliquely. At this time, damage to the heating element of the first planar heater 108-1 can be prevented, while maintaining the original shape of the ice tray 102 as much as possible. The first adhesive member 112-1 can be provided on one surface of the first planar heater 108-1 to be adhered to the ice tray 102. The first heat insulating member 114-1 can be provided on the other surface of the first planar heater 108-1. By the first heater receiving unit 106-1, the position of the first planar heater 108-1 can be fixed while preventing the leakage of the first adhesive member 112-1

Figure 5:
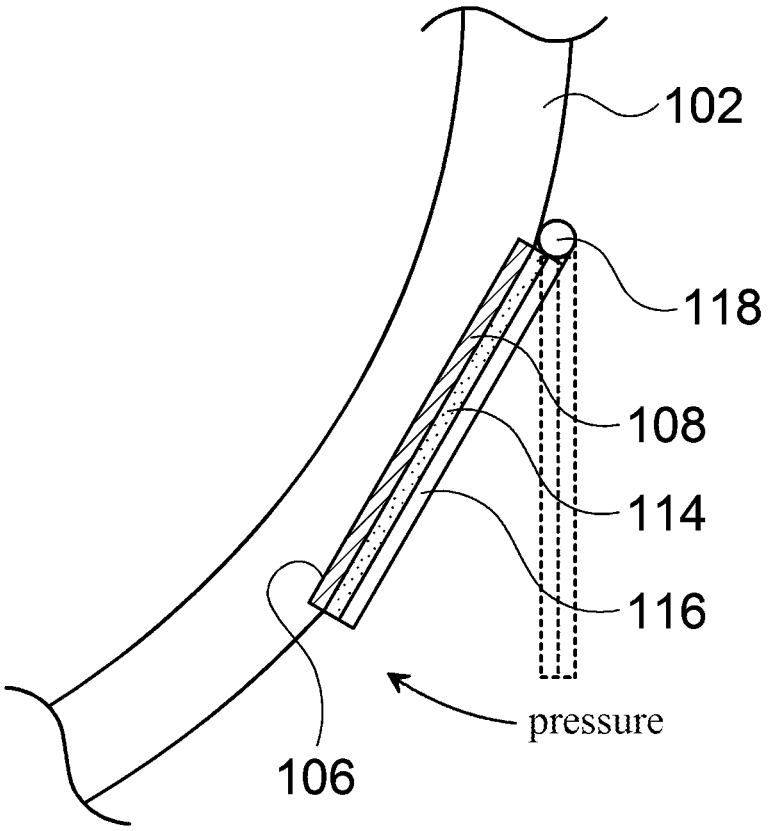
FIG. 5 is a cross-sectional view showing an ice maker according to another embodiment of the present disclosure.

FIG. 5 is a cross-sectional view showing an ice maker according to another embodiment of the present disclosure.

Referring FIG. 5, the ice maker 100 may further include a heater pressuring unit 116 and elastic member 118.

The heater receiving unit 106 may be provided on the outer circumferential surface of the ice tray 102. The heater receiving unit 106 may be provided on the outer circumferential surface of the ice tray 102 in the form of a receiving groove. In this case, in the heater receiving unit 106, a surface on which the planar heater 108 (that is, the bottom surface of the receiving groove) is mounted may be provided in a plane. Here, although the heater receiving unit 106 is shown in the form of the receiving groove to receive the planar heater 108, the present disclosure is not limited thereto, and the heater receiving unit 106 can be provided in the form of a receiving protrusion unit which protrudes from the outer circumferential surface of the ice tray 102.

The heater pressuring unit 116 serves to pressure the planar heater 108 from the other side of the planar heater 108 such that the planar heater 108 may be in closely contacted with the ice tray 102. The heater pressuring unit 116 may be provided in a shape corresponding to the entire area of the planar heater 108 so as to pressure the entire area of the planar heater 108. That is, the heater pressuring unit 116 may be provided along the length of the planar heater 108 in the ice tray 102. The heat insulating member 114 may be provided on one surface of the heater pressuring unit 116 (that is, a surface opposite to the planar heater 108).

The elastic member 118 can be provided to be fixed to the upper side of the heater receiving unit 106 in the ice tray 102. The heater pressuring unit 116 may be coupled with the elastic member 118 rotatably. The elastic member 118 serves to provide an elastic force such that the heater pressuring unit 116 can pressure the planar heater 108. In other words, the elastic member 118 provides the elastic force to the pressuring unit 116 toward the ice tray 102.

In a state where the heater pressuring unit 116 is hold and rotates in the outward direction (in FIG. 5, anti-clockwise), the planar heater 108 is positioned to the heater receiving unit 106. In this case, the elastic member 118 provides the elastic force in the inward direction (in FIG. 5, clockwise) of the ice tray 102. Thus, if the heater pressuring unit 116 is released, the heater pressuring unit 116 pressures the other surface of the planar heater 108 while rotating in the inner side of the ice tray 102. In this case, the planar heater 108 can be in closely contacted with the ice tray 102 without the need for additional adhesive member to improve the thermal conduction efficiency.

Meanwhile, although it is shown that the elastic member 118 is be provided on the upper side of the heater receiving unit 106, the present disclosure is not limited thereto, and the elastic member 118 may be provided on the lower side of the heater receiving unit 106.

Figure 6:
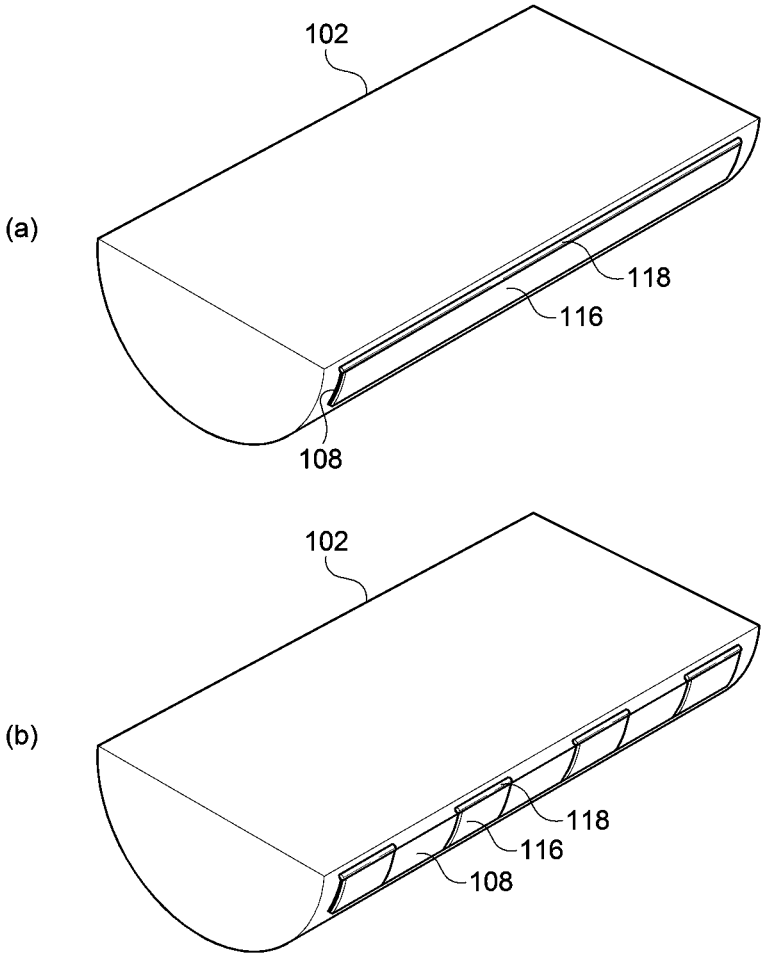
FIG. 6 is a view showing an embodiment in which a heater pressuring unit is formed in the ice tray, in the ice maker according to another embodiment of the present disclosure.

FIG. 6 is a view showing an embodiment in which a heater pressuring unit is formed in the ice tray, in the ice maker according to another embodiment of the present disclosure.

Referring to (a) of FIG. 6, the planar heater 108 may be provided along the longitudinal direction of ice tray 102 on the outer circumferential surface of the ice tray 102. The elastic member 118 may be provided along the longitudinal direction of the planar heater 108 on the upper side of the planar heater 108. The heater pressuring unit 116 may be provided to be rotatably coupled to be rotatable with the elastic member 118 and to be corresponded to the entire area of the planar heater 108 so as to pressure the entire area of the planar heater 108.

Referring to (b) of FIG. 6, the planar heater 108 may be provided along the longitudinal direction of the ice tray 102 on the outer circumferential surface of the ice tray 102. A plurality of elastic members 118 may be provided to be separated from the upper side of the planar heater 108 along the longitudinal direction of the planar heater 108. The heater pressuring unit 116 may be rotatably coupled with the plurality of elastic members 118, respectively. In this case, the heater pressuring unit 116 can pressure planar heater 108 for each predetermined length interval in the longitudinal direction of the planar heater 108.

Figure 7:
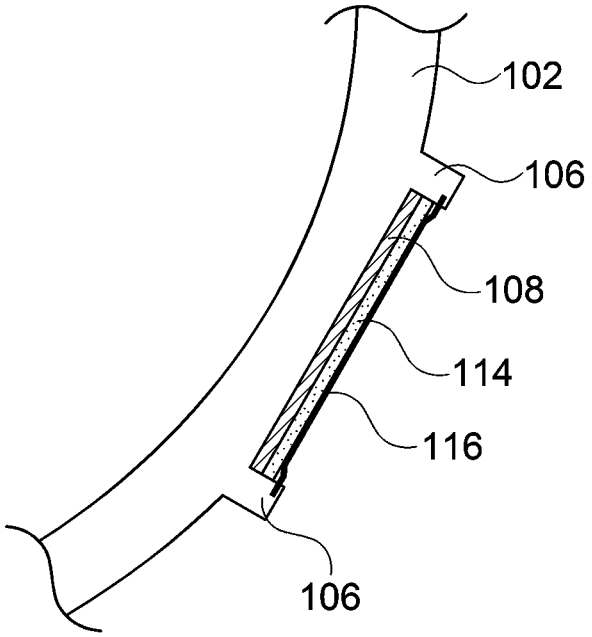
FIG. 7 is a view showing another embodiment of the heater pressuring unit, in the ice maker according to another embodiment of the present disclosure.

FIG. 7 is a view showing another embodiment of the heater pressuring unit, in the ice maker according to another embodiment of the present disclosure.

Referring to FIG. 7, the heater receiving unit 106 may be made of a receiving protrusion unit protruded and provided on the outer circumferential surface of the ice tray 102. The heater receiving unit 106 can be made of a pair of receiving protrusion units spaced at a predetermined interval (for example, an interval corresponding to the width of the planar heater 108) on the outer circumferential surface of the ice tray 102. In this case, the heater receiving unit 106-1 may be provided to have a size and shape corresponding to the planar heater 108 such that the both side of the planar heater 108 may be mounded into the inner wall of the heater receiving unit 106.

Here, the both sides of the heater pressuring unit 116 may be provided to pressure the other surface of the planar heater 108 in a state which is each fixed to the heater receiving unit 106 protruded from the outer circumferential surface of the ice tray 102. For heater pressuring unit 116, a plate spring may be used, for example. A heat insulating member 114 may be provided on one surface of the heater pressuring unit 116 or the other surface of the planar heater 108.

On the other hands, the receiving unit 106 is made in the form of the receiving protrusion unit, but is not limited to. For example, the heater receiving unit 106 may be made in the form of a receiving groove.

Figure 8:
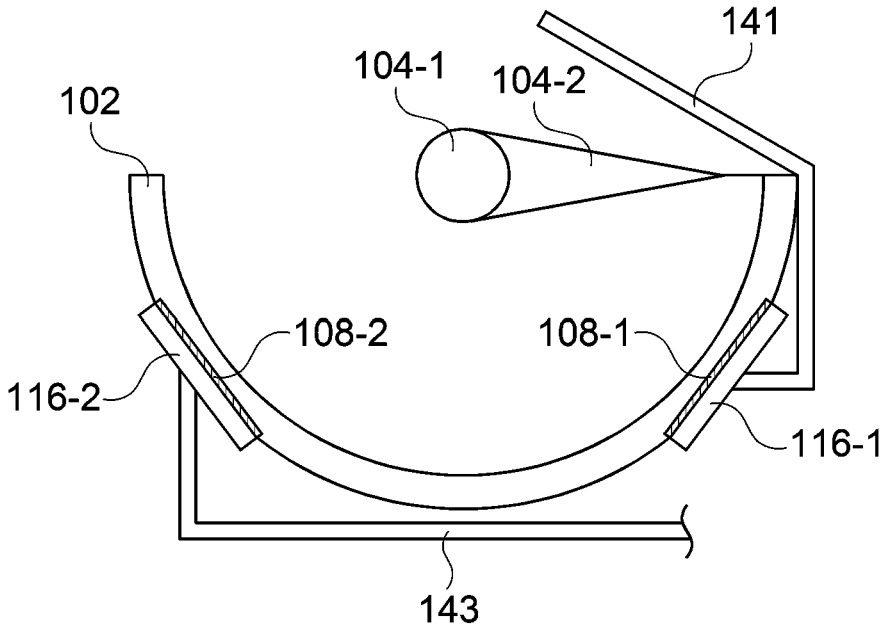
FIG. 8 is a view showing still another embodiment of the heater pressuring unit, in the ice maker according to another embodiment of the present disclosure.

FIG. 8 is a view showing still another embodiment of the heater pressuring unit, in the ice maker according to another embodiment of the present disclosure.

Referring to FIG. 8, the ice maker 100 may further include a guide unit 141 provided on one side portion of the ice tray 102 and a heater cover 143 provided on the lower portion of the ice tray 102. The guide unit 141 serves to guide the ice-separated ice to an ice bank (not shown) provided on the lower portion of the ice tray 102 when the ejector 104 rotates and the ice within the ice tray 102 is ice-separated. The guide unit 141 may be provided along the one side portion of the ice tray 102 to be obliquely formed in a direction of the lower portion from the upper portion of the ice tray 102. The heater cover 143 may be provided to have the separated space between the ice tray 102 and the lower portion of the ice tray 102. The cooled air can be moved to the separated space between the heater cover 143 and the ice tray 102. The heater cover 143 can protect the planar heater 108 from the external environment.

The first heater pressuring unit 116-1 may be provided to pressure the first planar heater 108-1 provided on the one side of the outer circumferential surface of the ice tray 102. The first heater pressuring unit 116-1 may be provided to extend from the guide unit 141 to the ice tray 102 side and to pressure the other side of the first planar heater 108-1. In this case, a heat insulating member (not shown) may be provided between the first planar heater 108-1 and the first heater pressuring unit 116-1.

The second heater pressuring unit 116-2 may be provided to pressure a second planar heater 108-2 provided on the other side of the outer circumferential surface of the ice tray 102. The second heater pressuring unit 116-2 may be provided to extend from the heater cover 143 to the ice tray 102 side and to pressure the second planar heater 108-2. In this case, a heat insulating member (not shown) may be provided between the second planar heater 108-2 and the second heater pressuring unit 116-2.

Here, although it is described that the first heater pressuring unit 116-1 is provided to extend from the guide unit 141 to the ice tray 102 side and the second heater pressuring unit 116-2 is provided to extend from the heater cover 143 to the ice tray 102 side, the first heater pressuring unit 116-1 and the second heater pressuring unit 116-2 both may be provided to extend from the heater cover 143 to the ice tray 102 side. The heater cover 143 may be provided between the first planar heater 108-1 and the second planar heater 108-2 in the lower portion of the ice tray 102. In addition, the cooled air can be moved to a space between the heater cover 143 and the ice tray 102. In this case, the first heater pressuring unit 116-1 and the second heater pressuring unit 116-2 may be provided to extend from the both ends of the heater cover 143 to the outside and to pressure the first planar heater 108-1 and the second planar heater 108-2.

Figure 9:
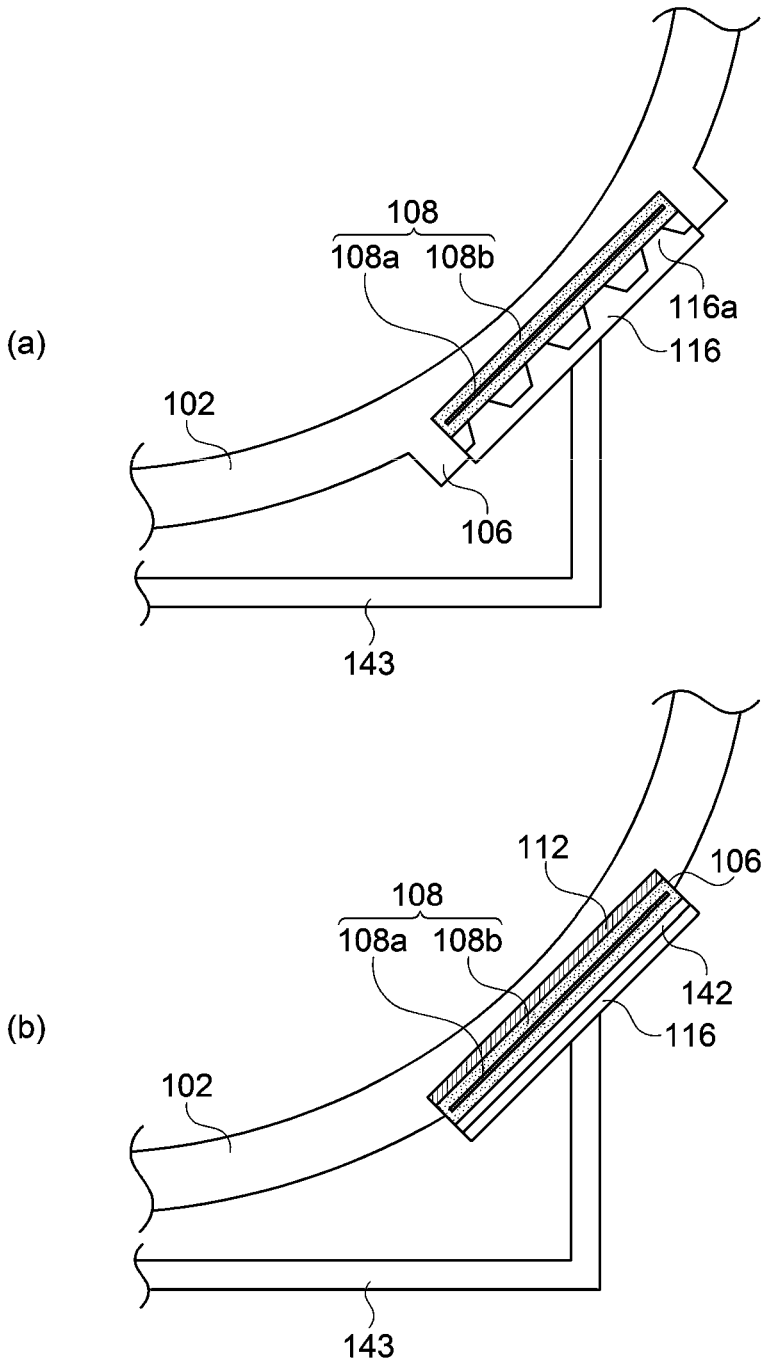
FIG. 9 is a view showing yet another embodiment of the heater pressuring unit, in the ice maker according to another embodiment of the present disclosure.

FIG. 9 is a view showing yet another embodiment of the heater pressuring unit, in the ice maker according to another embodiment of the present disclosure.

Referring to (a) of FIG. 9, the planar heater 108 may include a heating element **108*a* and an insulating member 108*b* and may be received in a heater receiving unit 106 provided to protrude from the outer circumferential surface of the ice tray 102. The one surface of the planar heater 108 is provided to be opposite to the ice tray 102. The one surface of the planar heater 108 may be provided to be in contacted with the ice tray 102, but is not limited thereto. For example, an adhesive member (for example, adhesive film and the like) may be provided between the planar heater 108 and the ice tray 102. The heater pressuring unit 116 may be provided to extend from the heater cover 143 to the ice tray 102 side and to pressure the other surface of the planar heater 108**.

The heater pressuring unit 116 can be inserted and fixed to the inner side of the heater receiving unit 106. In addition, at least one pressuring protrusion **116*a* may be provided in the heater pressuring unit 116. The pressuring protrusion 116*a* protrudes from the heater pressuring unit 116 to the planar heater 108 side and pressures the other surface of the planar heater 108. An end of the pressuring protrusion 116*a* may be provided to be in surface-contacted with the other surface of the planar heater 108. For example, the pressuring protrusion 116*a* may have a trapezoidal shape or a square shape and the like. However, the present disclosure is not limited thereto and the pressuring protrusion 116*a*** may be formed in various shapes of a semi-circular or a triangular and the like besides those.

Referring to (b) of FIG. 9, the planar heater 108 includes the heating element **108*a* and the insulating member 108*b* to be received in the heater receiving unit 106 provided in the form of a receiving groove on the outer circumferential surface of the ice tray 102. The heater pressuring unit 116 may be provided to extend from the heater cover 143 to the ice tray 102 side and to pressure the other surface of the planar heater 108. A contact member 142 may be provided between the planar heater 108 and the heater pressuring unit 116. For example, the contact member 142** may be a film type of an insulating member or a heat-resistant member, but is not limited to. For example, a cushioning member (for example, a rubber, silicon, urethane or the like) may be used besides those.

Figure 10:
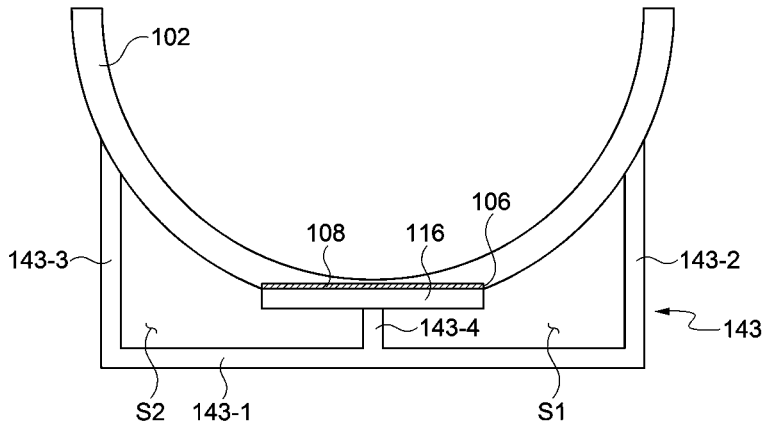
FIG. 10 is a view showing a state where a heater cover is provided with a heater pressuring unit, in the ice maker according to another embodiment of the present disclosure.
Figure 10:
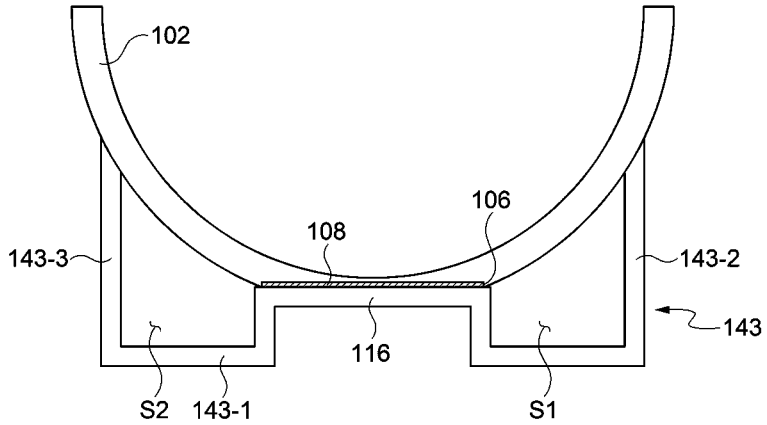

FIG. 10 is a view showing a state where a heater cover is provided with a heater pressuring unit, in the ice maker according to another embodiment of the present disclosure.

Referring to (a) of FIG. 10, the planar heater 108 may be received in a heater receiving unit 106 formed on the lower portion of the ice tray 102. The heater receiving unit 106 may be provided on the center portion of the ice tray 102 in the outer circumferential surface of the ice tray 102 having a semicircular arc shape. An area of the ice tray 102 opposite to the planar heater 108 from the heater receiving unit 106 may be provided in a plane.

The heater cover 143 may include a base plate 143-1 provided on the lower portion of the ice tray 102, a first side plate 143-2 which extends from one side of the base plate 143-1 to one side of the outer circumferential surface of the ice tray 102, a second side plate 143-3 which extends from the other side of the base plate 143-1 to the other side of the outer circumferential surface of the ice tray 102, and a support plate 143-4 which extends from the center portion of the base plate 143-1 to the ice tray 102 side. Here, the heater pressuring unit 116 may be provided to be pressured from the support plate 143-4 to the planar heater 108. The heater pressuring unit 116 may be provided to extend from the support plate 143-4 to the both sides so as to be corresponded to the planar heater 108. In this case, a first cooled air movement flow path S1 is provided between the support plate 143-4 and the first side plate 143-2 and a second cooled air movement flow path S2 is provided between the support plate 143-4 and the second side plate 143-3.

(b) of FIG. 10 is a view showing another embodiment of a heater cover 143. Referring to (b) of FIG. 10, the heater cover 143 may include a base plate 143-1 provided on the lower portion of the ice tray 102, a first side plate 143-2 which extend from one side of the base plate 143-1 to one side of the outer circumferential surface of the ice tray 102, and a second side plate 143-3 which extend from the other side of the base plate 143-1 to the other side of the outer circumferential surface of the ice tray 102.

Here, the heater pressuring unit 116 may be provided such that the portion of the base plate 143-1 corresponding to the heater receiving unit 106 (or a planar heater 108) protrudes to the ice tray 102 side to pressure the planar heater 108. A first cooled air movement flow path S1 is provided between the heater pressuring unit 116 and the first side plate 143-2, and a second cooled air movement flow path S2 is provided between the heater pressuring unit 116 and the second side plate 143-3.

Figure 11:
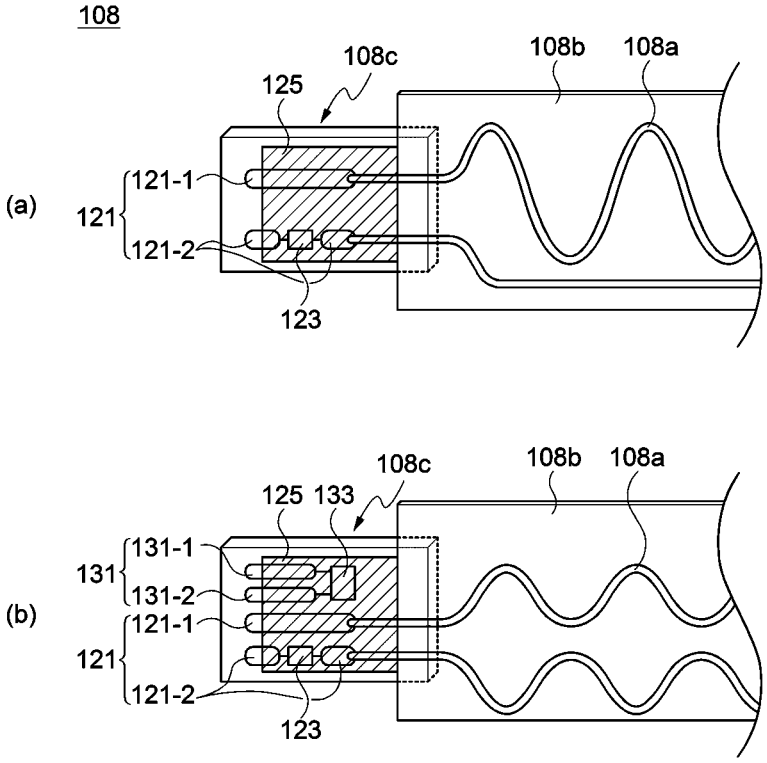
FIG. 11 is a view showing a planar heater, in an ice maker according to an embodiment of the present disclosure.

FIG. 11 is a view showing a planar heater, in the ice maker according to another embodiment of the present disclosure.

Referring to (a) of FIG. 11, the planar heater 108 may include a heating element 108*a*, an insulating member 108*b* and a power connecting unit 108*c*.

The power connecting unit 108*c* can be made of a PCB (Printed Circuit Board) or a metal PCB. The power connecting unit 108*c* may include a first electrode pad 121, a power cut-off unit 123 and an insulating layer 125. The first electrode pad 121 may include a first-1 electrode pad 121-1 to which one end of the heating element 108*a* is electrically connected, and a first-2 electrode pad 121-2 provided to be separated to the first-1 electrode pad 121-1 and connected to the other end of the heating element 108*a*. The first electrode pad 121 may be connected to a connector 110*a* provided within the control box 110. The first-2 electrode pad 121-2 may be provided such that a portion to which the other end of the heating element 108*a* is eclectically connected and a portion connected to the connector 110*a* may be each separated.

A power cut-off unit 123 may be provided to electrically connect the each separated portion of the first-2 electrode pads 121-2. However, the present disclosure is not limited thereto and the first-1 electrode pads 121-1 may be provided to be electrically separated from each other. The power cut-off unit 123 serves to cut off the power applied to the heating element when the temperature of the heating element 108*a* exceeds a predetermined temperature. For example, the power cut-off unit 123 may be made of, but is not limited thereto, a thermal fuse or a bimetal. In this case, the power cut-off unit 123 may be implemented without the need for an additional temperature sensor. In addition, the power cut-off unit 123 can cut-off the power applied to the heating element 108*a* when an over-current flows on the heating element 108*a*. Thus, the planar heater 108 is provided in the form of a modular type to include the power connecting unit 108*c* made of a PCB or metal PCB, whereby the power cut-off unit 123 can be formed on the power connecting unit 108*c* by means of a simple structure and circuit.

The insulating layer 125 may be provided to wrap the heating element 108*a*, the electrode pad 121 and the power cut-off unit 123 on the power connecting unit 108*c*. The insulating layer 125 serves to protect the heating element 108*a*, the electrode pad 121 and the power cut-off unit 123 from an external environment. The insulating layer 125 is not provided on a portion which connected to the connector 110*a* in the electrode pad 121.

Referring to (b) of FIG. 11, a second electrode pad 131 and a temperature sensor 133 are provided on the power connecting unit 108*c* of the planar heater 108. The temperature sensor 133 can measure a temperature of the planar heater 108. The temperature sensor 133 is electrically connected to the second electrode pad 131. In addition, the second electrode pad 131 is connected to a connector 110*a* provided within the control box 110. The temperature sensor 133 can transmit information of the measured temperature to a control unit (not shown) through the connector 110*a*. The control unit (not shown) can generate a control signal to the power cut-off unit 123 to cut-off the power applied to the heating element 108*a* when the temperature of the planar heater 108 exceeds a predetermined temperature. In this case, the power cut-off unit 123 may be made of a switching device. Meanwhile, the temperature sensor 133 may be provided to measure the temperature of the ice tray 102.

On the other hand, outer covers of the planar heater 108 may be cross-linked through an electron beam irradiation. For example, an additional insulating layer may be formed on the insulating member 108*b* of the planar heater 108 and cross-linked to the insulating layer through the electron beam irradiation. In addition, the insulating member 108*b* may be made of EVA (Ethylene Vinyl Acetate), PE (Polyethylene) and the like cross-linked through the electron beam irradiation. For example, if the insulating member 108*b* is made of the PE (Polyethylene), radicals are generated while H-ions are dissociated from a polyethylene chain when accelerated electron beams are irradiated to the insulating member 108*b*, and the cross-link is proceed by a combination of radicals. In this case, since the polyethylene has a network structure by the combination of the radicals, the heat-resistant temperature of the insulating member 108*b* can be improved, thereby improving brittleness of the planar heater 108.

In addition, an outer cover of the planar heater 108 may be a shrink tube. For example, the shrink tube may be provided to wrap the insulating member 108*b* of the planar heater 108. In addition, the shrink tube may be used for the insulating member 108*b*. The shrink tube may be a shrink tube cross-linked with the electron beam irradiation.

Figure 12:
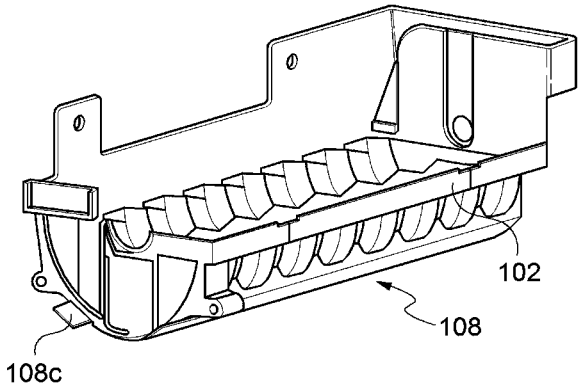
FIG. 12 is a view showing a state where a planar heater is mounted into the ice tray, in an ice maker according to an embodiment of the present disclosure.
Figure 12:
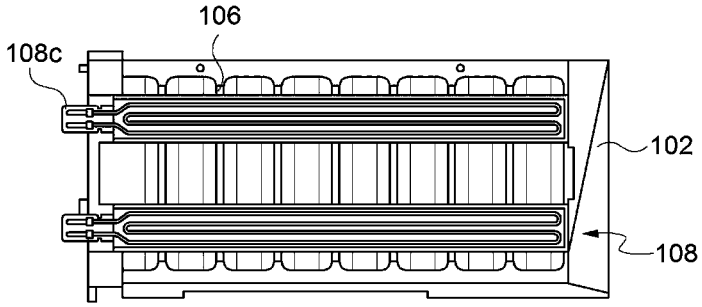

FIG. 12 is a view showing a state where a planar heater is mounted into the ice tray, in the ice maker according to an embodiment of the present disclosure.

Referring to FIG. 12, the planar heater 108 may be mounted to be received in the heater receiving unit 106 provided on the outer circumferential surface of the ice tray 102. The heater receiving unit 106 may be provided along the longitudinal direction of the ice tray 102 from the one side and the other side of the outer circumferential surface of the ice tray 102. The planar heater 108 may be provided with a power connecting unit 108*c* for applying power to the planar heater 108. In this case, the one side of the power connecting unit 108*c* may be mounted on the outer circumferential surface of the ice tray 102, and the other side of the power connecting unit 108*c* may be provided to protrude to the control box (not shown) side. The other side of the power connecting unit 108*c* may be inserted into the control box (not shown) to be connected to a connector within the control box (not shown). The planar heater 108 may be formed of an integrated PCB or metal PCB. In other words, although the power connecting unit 108*c* may be formed of an integrated PCB or a metal PCB, the heating element 108*a* may be provided on an integrated PCB or metal PCB to extend from the power connecting unit 108*c* as well, and the insulating member 108*b* may be provided to wrap the heating element 108*a* on the extended PCB or metal PCB.

Figure 13:
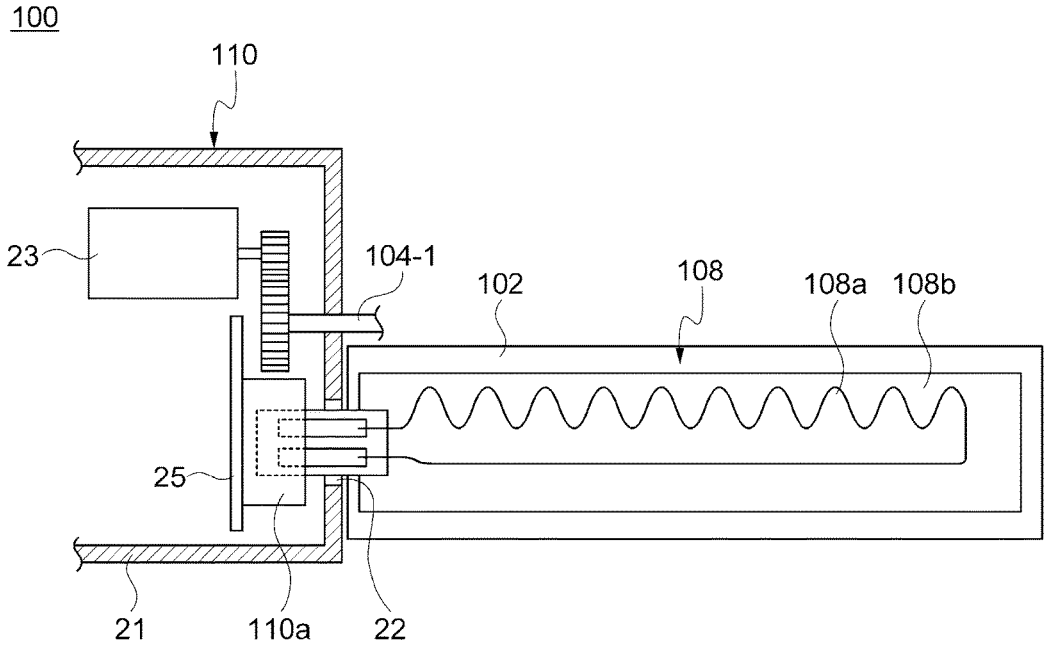
FIG. 13 is a view showing a state where a power connecting unit of a planar heater is connected to a connector in a control box, in an ice maker according to an embodiment of the present disclosure.

FIG. 13 is a view showing a state where a power connecting unit of a planar heater is connected to a connector in a control box, in the ice maker according to an embodiment of the present disclosure.

Referring to FIG. 13, the control box 110 may be provided on the one side of the ice tray 102. An ice-separating motor 23 to rotate an ejector shaft 104-1 may be provided on the inner side of the control box 110. The ice-separating motor 23 and the ejector shaft 104-1 may be interconnected through a series of gears. A main board 25 to control the ice maker 100 may be provided on the inner side of the control box 110. The main board 25 may be formed of a printed circuit board. The main board 25 may be provided with a connector 110*a*. Here, the main board 25 is provided with the connector 110*a*, but is limited to. For example, the connector 110*a* may be provided on an additional printed circuit board for supplying power.

The housing 21 of the control box 110 may be formed with a through-hole 22. The through-hole 22 may be provided on a surface opposite to the ice tray 102 in the housing 21. A power connecting unit 108*c* of the planar heater 108 is inserted into the through hole 22 to be connected to a connector 110*a*. In other words, as shown in FIG. 12, the one side of the power connecting unit 108*c* is mounded on the outer circumferential surface of the ice tray 102 and the other side of the power connecting unit 108*c* may be provided to protrude to the control box 110 side. In this case, the other side of the power connecting unit 108*c* which protrudes to control box 110 side is inserted into the through-hole 22 to be connected to the connector 110*a*. The connector 110*a* is provided with a connecting terminal (not shown) which is electrically connected to an electrode pad 108*c*-1 of the power connecting unit 108*c*. The planar heater 108 is directly connected to the connector 110*a* without any lead wire (or a lead cable)

The connector 110*a* may be electrically connected to a power supply unit (not shown). In addition, the planar heater 108 can receive power from the connector 110*a*. In other words, the power supplied from the connector 110*a* is applied to the power connecting unit 108*c*, thereby operating the heating element 108*a*

Figure 14:
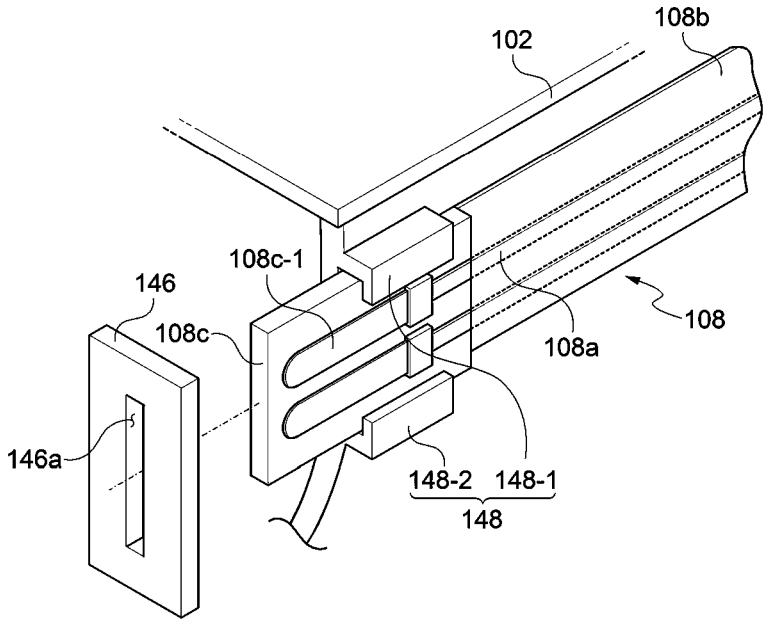
FIG. 14 is a view showing a state where a power connecting unit of a planar heater is mounded into an ice tray, in an ice maker according to an embodiment of the present disclosure.

FIG. 14 is a view showing a state where a power connecting unit of a planar heater is mounded into the ice tray, in the ice maker according to an embodiment of the present disclosure.

Referring to FIG. 14, a mounting guide unit 148 may be provided on the outer circumferential surface of the ice tray 102. The mounting guide unit 148 may include a first mounting guide unit 148-1 and a second mounting guide unit 148-2. The first mounting guide unit 148-1 may be provided to protrude from and to be bent to the outer circumferential surface of the ice tray 102. The first mounting guide unit 148-1 is bent to the lower side thereof and accordingly, the inner side thereof is provided with a guide groove. The second mounting guide unit 148-2 is provided to be separated from the lower side of the first mounting guide unit 148-1. The second mounting guide unit 148-2 may be provided to protrude from the outer circumferential surface of the ice tray 102 and be bent to the upper side thereof. The second mounting guide unit 148-2 is bent to the upper side thereof and accordingly, the inner side thereof is provided with a guide groove. The first mounting guide unit 148-1 and the second mounting guide unit 148-2 may be provided to be symmetrical vertically. The first mounting guide unit 148-1 and the second mounting guide unit 148-2 may be provided along the longitudinal direction of the ice tray 102. At least one of the first mounting guide unit 148-1 and the second mounting guide unit 148-2 may be provided to be separated on the outer circumferential surface of the ice tray 102.

The planar heater 108 may include a heating element 108*a*, an insulating member 108*b*, and a power connecting unit 108*c*. The heating element 108*a* and the insulating member 108*b* may be received in the heater receiving unit 106 provided on the ice tray 102. The heating element 108*a* is electrically connected to an electrode pad 108*c*-1 formed on the power connecting unit 108*c*. In addition, the power connecting unit 108*c* may be mounted into and fixed to the mounting guide unit 148. Specifically, the power connecting unit 108*c* may be inserted between the first mounting guide unit 148-1 and the second mounting guide unit 148-2 and may be mounted and fixed on the outer circumferential surface of the ice tray 102.

Meanwhile, when the power connecting unit 108*c* is inserted and connected to the connector 110*a*, a packing member 146 may be provided between the control box 110 and the ice tray 102. The packing member 146 may be provided to seal the through-hole 22. In other words, when the protruded outer side of the power connecting unit 108*c* is inserted onto the through-hole 22 and is connected to the connector 110*a*, the packing member 146 can be provided to seal the through-hole 22. The packing member 146 may be provided to have an extended surface in a direction crossing to an inserting direction of the connector 110*a* of the power connecting unit 108*c*. The packing member 146 is formed with an inserting hole 146*a* into which an end of the power connecting unit 108*c* is inserted and fitted. When the power connecting unit 108*c* is connected to the connector 110*a*, the packing member 146 can serve to prevent the cooled air or the moisture of the ice tray 102 from entering the inner portion of the control box 110 by sealing the through-hole 22. Here, the packing member 146 is shown in a rectangular shape, but is limited to. For example, the packing member 146 may be formed of a shape to seal the through-hole 22 depending on the shape of the through-hole 22.

Figure 15:
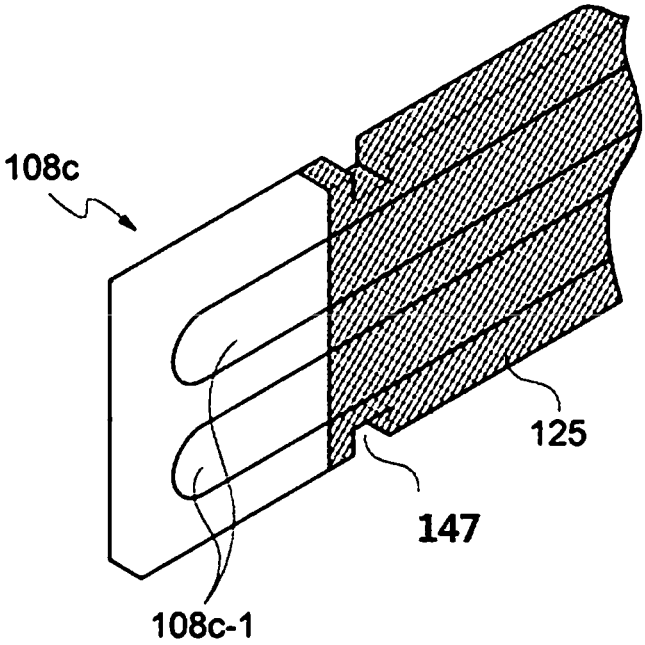
FIG. 15 is a view showing a state where grooves are formed on the upper and lower long sides of the power connecting unit, respectively in a planar heater according to an embodiment of the present disclosure.

In addition, as shown in FIG. 15, the power connecting unit 108*c* may include grooves 147 each formed on the upper and lower long sides such that the packing member 146 inserted into the power connecting unit 108*c* can hang in the groove 147. In other words, the packing member 146 can be inserted and fitted to power connecting unit 108*c* through the inserting hole 146*a*. In this case, the upper end and lower end of the inserting hole 146*a* of the packing member 146 may be hanged in the grooves 147 formed on the upper and lower long sides of the power connecting unit 108*c*, respectively. Here, the length of the inserting hole 146*a* may be provided slightly shorter than the sectional length of the power connecting unit 108*c*.

According to this configuration, when the planar heater 108 is fitted to the connector 110*a* or removed from the connector 110*a*, a position of packing member 146 can be maintained on the power connecting unit 108*c*. As a result, in order to repair the planar heater 108, even if the planar heater 108 is removed from the connector 110*a* and then the planar heater 108 is again inserted into the connector 110*a*, since the position of the packing member 146 is not changed, the packing member 146 can accurately seal the through-hole 22.

As above described, the grooves 147 can be formed on the upper and lower long sides (edge portions) of the power connecting unit 108*c*, respectively, but the grooves 147 may be formed on only one side of two sides or formed on one surface or both surfaces of the power connecting unit 108*c* in the form of a groove or notch as well. In addition, referring to FIG. 15, it may be noted that the insulating layer 125 is provided to extend to end portion of the power connecting unit 108*c* rather than a position at which the packing member 146 is mounted into the power connecting unit 108*c* and thus, the electrode pad 108*c*-1 is provide to be not exposed to the outside air when the plate heater 108 is connected to connector 110*a*.

In the ice maker 100 according to the embodiment of the present disclosure, the planar heater 108 mounted into the ice tray 102 can be easily inserted into or removed from the connector 110*a* within the control box 110. As a result, during the assembly of the ice maker 100, the planar heater 108 can be easily mounted and further, the planar heater 108 can be easily repaired or replaced during the use of the ice maker 100.

Figure 16:
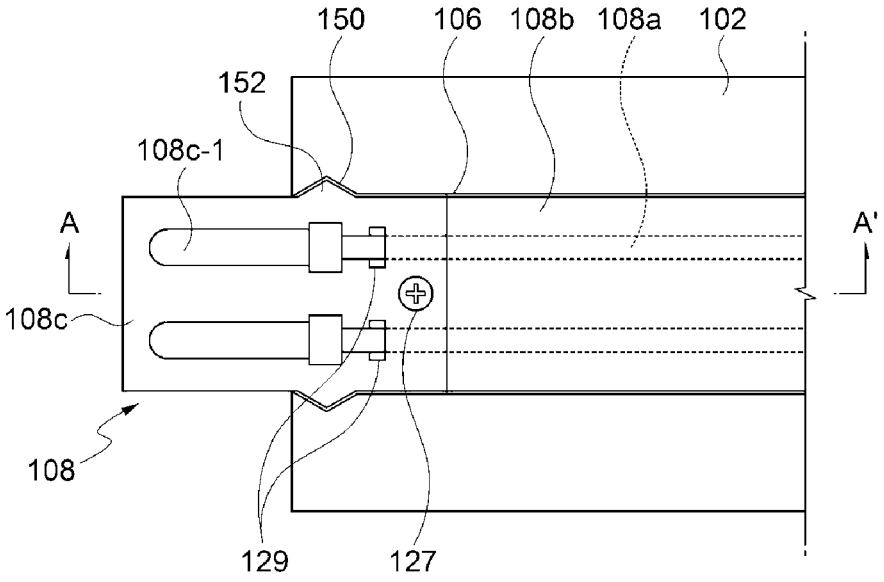
FIG. 16 is a view showing another embodiment in which a power connecting unit of a planar heater is mounted into an ice tray, in an ice maker according to an embodiment of the present disclosure.
Figure 17:
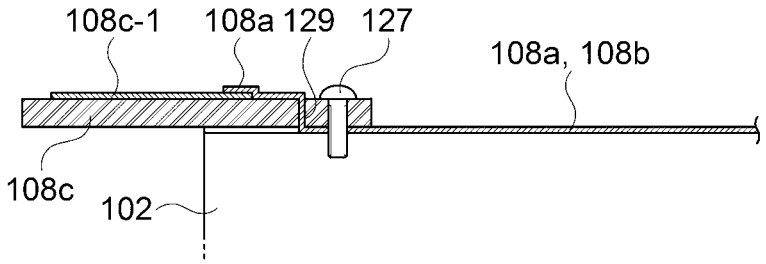
FIG. 17 is a cross-sectional view taken along a line A-A' in FIG. 16.

FIG. 16 is a view showing another embodiment in which a power connecting unit of a planar heater is mounted into an ice tray, in the ice maker according to another embodiment of the present disclosure, and FIG. 17 is a cross-sectional view taken along a line A-A' in FIG. 16.

Referring to FIGS. 16 and 17, the heater receiving unit 106 may be provided on the outer circumferential surface of the ice tray 102 along the longitudinal direction of the ice tray 102. In this case, the heater receiving unit 106 may be provided along the longitudinal direction of the ice tray 102 from one end of the ice tray 102 (that is, an end opposite to the control box 110) to the other of the ice tray 102. The heating element 108*a* and the insulating member 108*b* of the planar heater 108 can be received in the heater receiving unit 106. In addition, a portion of the power connecting unit 108*c* of the planar heater 108 can be received in the heater receiving unit 106. A mounting groove 150 extending from the heater receiving unit 106 may be provided on a portion into which the power connecting unit 108*c* of the heater receiving unit 106 is inserted. In addition, a protrusion 152 corresponded to a mounting groove 150 may be formed on the both sides of the power connecting unit 108*c*. As a result, the planar heater 108 is able to be fixed with respect to a direction (or vice versa) into which the connector 110*a* of the power connecting unit 108*c* is inserted.

Here, the power connecting unit 108*c* is able to be coupled with the ice tray 102 through a coupling member 127. For example, a bolt or screw may be used for the coupling member 127. In other words, the power connecting unit 108*c* may be screw-coupled with the ice tray 102 through the coupling member 127. The coupling member 127 allows the power connecting unit 108*c* to be coupled with the ice tray 102 by passing through the power connecting unit 108*c*. In addition, an inserting hole 129 may be formed in the power connecting unit 108*c*. The inserting hole 129 may be provided to be passed through the power connecting unit 108*c* in a thickness direction of the power connecting unit 108*c*.

The heating element 108*a* and the insulating member 108*b* of the planar heater 108 may be in closely contacted with the outer circumferential surface of the ice tray 102. One ends of the heating element 108*a* and the insulating member 108*b* can be in closely contacted with the ice tray 102 by pressuring the power connecting unit 108*c* from a lower portion of the power connecting unit 108*c*. In addition, one end of the heating element 108*a* can be electrically connected to the electrode pad 108*c*-1 after inserted into the inserting hole and exposed to the outside. In this case, the entire region of the heating element 108*a* and the insulating member 108*b* can be in closely contacted with the ice tray 102, and the electrical connection between the heating element 108*a* and the electrode pad 108*c*-1 can be stably maintained at the same time. Meanwhile, the insulating layer (not shown) may be provided to wrap the heating element 108*a* exposed to the outside and a portion of the electrode pad 108*c*-1.

Figure 18:
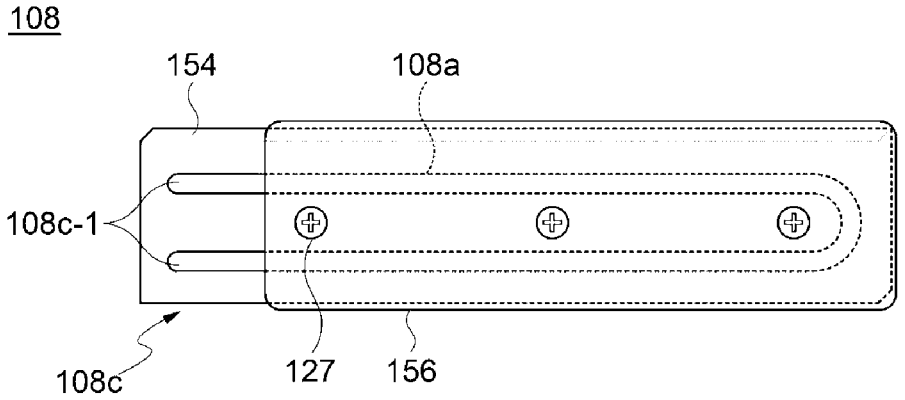
FIG. 18 is a view showing a planar heater according to one embodiment of the present disclosure.
Figure 18:
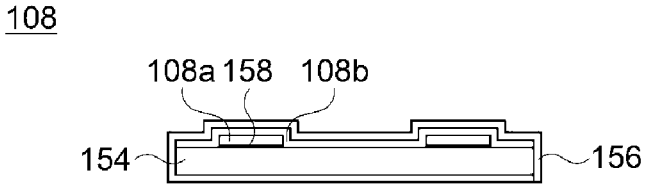

FIG. 18 is a view showing a planar heater according to an embodiment of the present disclosure.

Referring to FIG. 18, the entire region of the planar heater 108 may be made of a PCB (Printed Circuit Board) (or a metal PCB) 154. In other words, a base member of the planar heater 108 may be made of a PCB (or metal PCB) 154. In this case, the electrode pad 108*c*-1 and the heating element 108*a* can be formed on one surface of the PCB 154. The pad electrode 108*c*-1 and the heating element 108*a* can be integrally formed, but is not limited thereto. In addition, the heating element 108*a* is made of a metal thin film having a thickness of more than 0 mm and less than 0.5 mm, and then be adhered by an adhesive 158 to the one surface of the PCB 154. The insulating member 108*b* may be provided such that the heating element 108*a* is wrapped on one surface of the PCB 154. A portion connected to the connector 110*a* of the electrode pad 108*c*-1 is exposed to the outside. A portion in which the heating element 108*a* of the planar heater 108 is formed (that is, a portion except for the electrode pad 108*c*-1 connected to the connector 110*a*) can be wrapped by a shrink tube 156. The shrink tube 156 may be cross-linked by the electron beam irradiation. The planar heater 108 may be provided with at least one coupling member 127 passing through the planar heater 108. In case where the planar heater 108 is mounted into the ice tray 102, the coupling member 127 serves to couple the planar heater 108 to the ice tray 102

Figure 19:
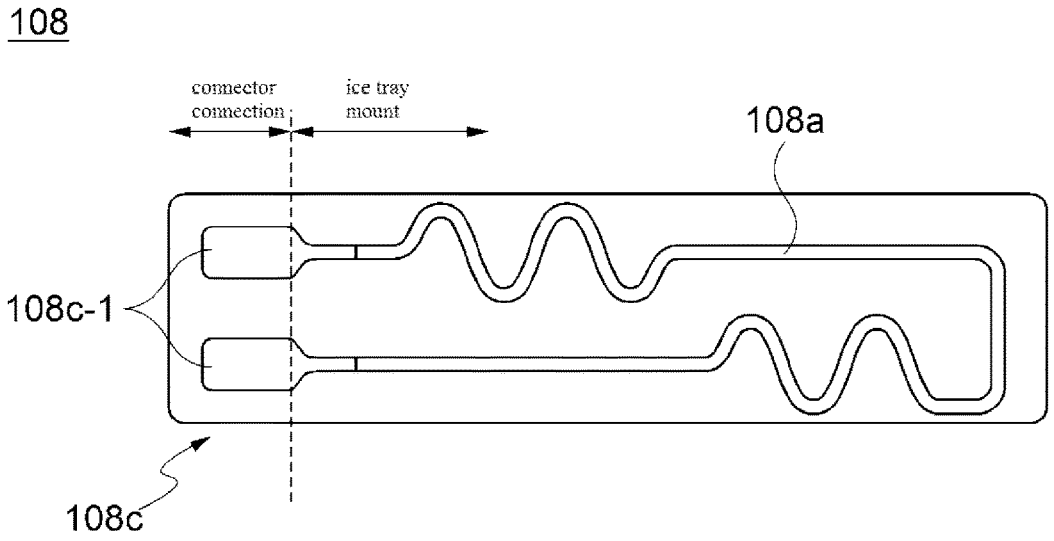
FIG. 19 is a view showing a planar heater according to another embodiment of the present disclosure.

FIG. 19 is a view showing a planar heater according to another embodiment of the present disclosure.

Referring to FIG. 19, a width or area of an electrode pad 108*c*-1 provided on the power connecting unit 108*c* of the planar heater 108 can be formed differently depending on the positions. For example, a width or area of a portion to which the electrode pad 108*c*-1 is connected to the connector 110*a* may be provided to be wider than those of a portion into which the ice tray 102 is mounted. In addition, the width of the electrode pad 108*c*-1 may be provided to be wider than that of the heating element 108*a*. In other words, the portion of the electrode pad 108*c*-1 connected to the heating element 108*a* is formed to have the same width as that of the heating element 108*a*, as shown in FIG. 19, but is not limited thereto. For example, the electrode pad 108*c*-1 may be provided to be wider than that of the heating element 108*a*.

Meanwhile, the heating density of the planar heater 108 may be formed differently depending on the position of the planar heater 108. In other words, the area of the planar heater 108 may be set to have a different area of the heating element 108*a* per a unit area and thus, the heating density may be differently depending on the position of the planar heater 108.

Figure 20:
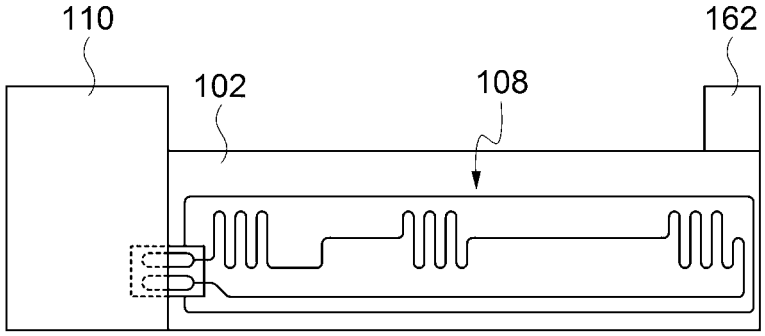
FIG. 20 is a view schematically showing a state where a planar heater according to an embodiment of the present disclosure is mounted into an ice tray.
Figure 20:
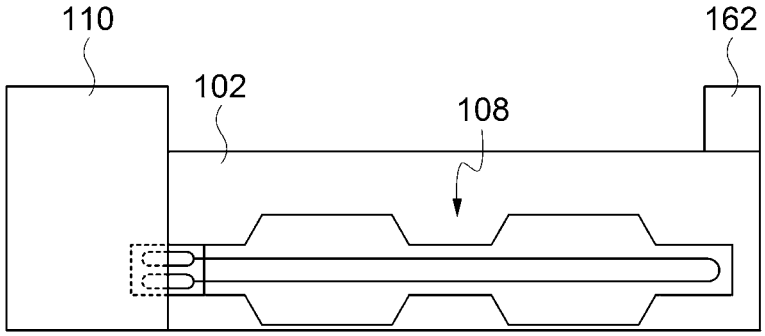

FIG. 20 is a view schematically showing a state where a planar heater according to an embodiment of the present disclosure is mounted into an ice tray.

Referring to (a) of FIG. 20, the planar heater 108 may be provided on the outer circumferential surface of the ice tray 102. The planar heater 108 may be provided from one end to the other end of the ice tray 102 along the longitudinal direction of the ice tray 102. The control box 110 may be provided to be opposite to the ice tray 102 on one end the ice tray 102. A water feeding unit 162 can be provided on the upper side of the other end of the ice tray 102 to be supply ice-making water to the inner portion of the ice tray 102.

Here, the planar heater 108 can be formed differently depending on the position corresponding to the ice tray 102. For example, in the planar heater 108, portions corresponding to one end of ice tray 102 and the other end of the ice tray 102 are formed to have a higher heating density (for example, density per a unit area of the heating element, etc.) than the other portions. Since the same structure as the control box 110 is provided on one end of the ice tray 102 and the same structure as the water feeding unit 162 is provided on the other end of the ice tray 102, when the ice tray 102 is heated through the planar heater 108, the heat can get out into the other structures. Thus, because portions corresponding to one end and the other end of the ice tray 102 in the planar heater 108 may be formed to have a higher heating density than the other portions, the ice can be uniformly separated from the entire region of the ice tray 102. In addition, a portion corresponding to a center portion of the ice tray 102 in the planar heater 108 can be formed to have a higher or lower heating density than the other portions.

Referring to (b) of FIG. 20, the planar heater 108 can be formed to have a different area (or heating area) depending on position corresponding to the ice tray 102. In other words, the area (or heating area) of the planar heater 108 can be differently formed depending on the position such that the ice is uniformly separated from the entire region of the ice tray 102. In this case, for a region having a narrow area of the planar heater 108, the density of the heating element 108*a* can be highly increased to further increase heating density. In addition, for a region having a large narrow area of the planar heater 108, the density of the heating element 108*a* can be reduced to further reduce the heating density, but is not limited thereto. For example, for a region having a narrow area of the planar heater 108, the density of the heating element 108*a* can be reduced, and for a region having a large narrow area of the planar heater 108, the density of the heating element 108*a* can be increased.

Figure 21:
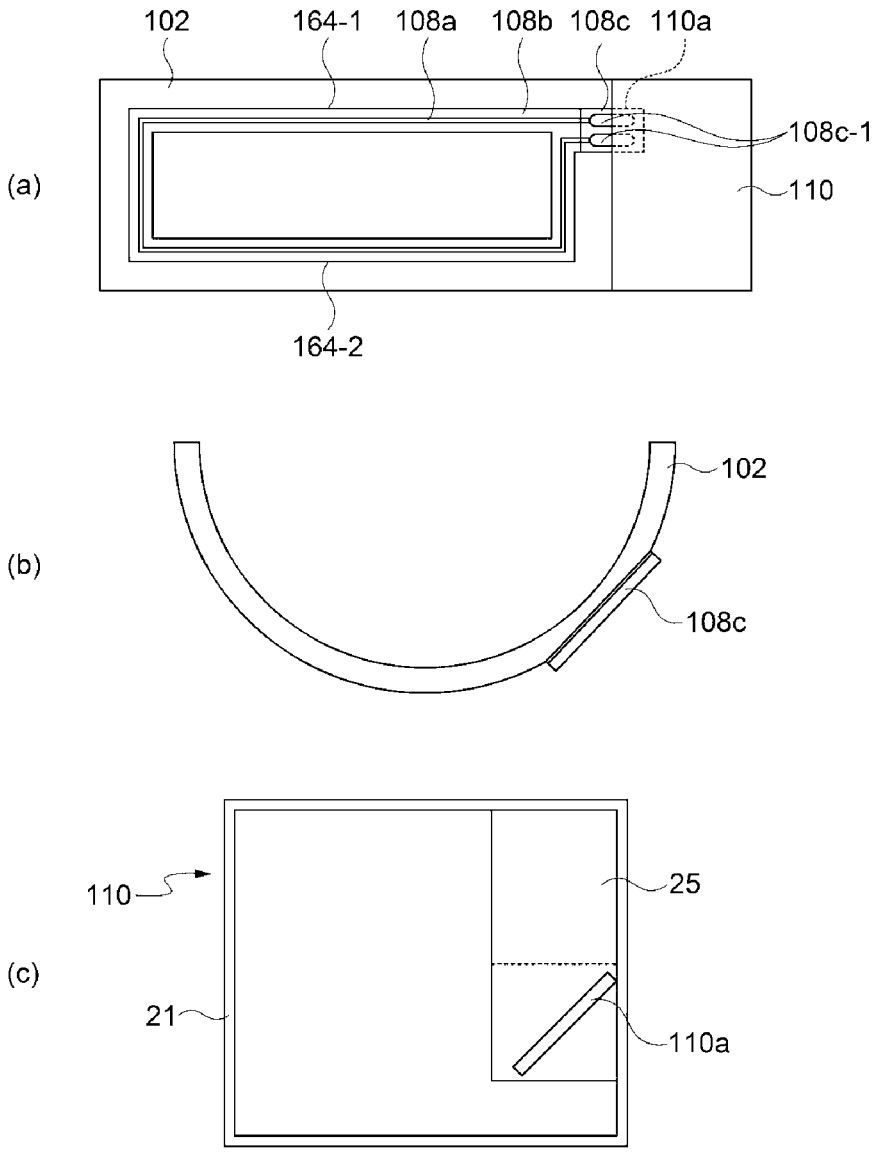
FIG. 21 is a view schematically showing a state where a planar heater provided in an ice tray is connected to a connector in a control box, in the ice maker according to still another embodiment of the present disclosure.

FIG. 21 is a view schematically showing a state where a planar heater provided at an ice tray is connected to a connector in a control box, in the ice maker according to another embodiment of the present disclosure. (a) of FIG. 21 is a view showing the ice tray as viewed from the bottom, (b) of FIG. 21 is a front view showing the ice tray as viewed from one end of the ice tray, and (c) of FIG. 21 is a view showing the inner portion of the control box as viewed from the front of the control box.

Referring to FIG. 21, the planar heater 108 may be provided on the outer circumferential surface of the ice tray 102. The power connecting unit 108*c* of the planar heater 108 may be provided such that the one end thereof protrudes from one side of the outer circumferential surface of the ice tray 102 (right side relative to the center of the ice tray 102 in FIG. 21 (*b*)) to the control box 110 side. The planar heater 108 may include a first planar heater unit 164-1 provided along the longitudinal direction of the ice tray 102 from one side of the outer circumferential surface of the ice tray 102 and a second planar heater unit 164-2 provided along the longitudinal direction of the ice tray 102 from the other side of the outer circumferential surface of the ice tray 102. A region between the first planar heater unit 164-1 and the second planar heater unit 164-2 at the ice tray 102 is exposed to the outside to form a cooled air contact zone.

The one end of the first planar heater unit 164-1 and the one end of the second planar heater unit 164-2 are connected to the power connecting unit 110*c*. In this case, the second planar heater unit 164-2 can be bent from the other side to the one side of the outer circumferential surface of the ice tray 102 to be connected to the power connecting unit 110*c*. Thus, a plurality of heating elements 108*a* of the planar heater 108 can be provided to be separated from the power connecting unit 108*c*.

The other end of the first planar heater unit 164-1 and the other end of the second planar heater unit 164-2 can be connected to each other. For example, the other end of the first planar heater unit 164-1 can be bent from one side to the other side of the outer circumferential surface of the ice tray 102 to be connected to the other end of the second planar heater unit 164-2. In addition, the other end of the second planar heater unit 164-2 can be bent from the other side to the one side of the outer circumferential surface of the tray 102 to be connected to the other end of the first planar heater unit 164-1, but is not limited thereto. For example, the other end of the first planar heater unit 164-1 and the other end of the second planar heater unit 164-2 may be separated from each other. In this case, the first planar heater unit 164-1 and the second planar heater unit 164-2 can be electrically connected to negative and positive electrode pads of the power connecting unit 108*c*, respectively.

The planar heater 108 can be provided in the form of a closed loop or a loop in which a portion is opened, from the outer circumferential surface of the ice tray 102. In this case, it is possible to ensure a cooled air contact zone, while widening a contact area (or heating area) in which the ice tray 102 can be in contacted with a single planar heater 108.

On the other hand, a printed circuit board 25 formed with the connector 110*a* can be provided within the control box 110. The printed circuit board 25 may be a main board provided with a control unit (not shown) to control overall operations of the ice maker 100. The printed circuit board 25 can be provided on a side corresponding to the power connecting unit 108*c* within a housing 21 of the control box 110. In other words, in FIG. 21(*c*), the printed circuit board 25 can be provided to be inclined to the right based on the center of the housing 21.

As a result, the power connecting unit 108*c* of the planar heater 108 protrudes from one side of the outer circumferential surface of the ice tray 102 to the control box 110 side and the printed circuit board 25 is provided on side corresponding to the power connecting unit 108*c* within the control box 110 and thus, the connector 110*a* connected to the power connecting unit 108*c* can be provided on the printed circuit board 25 without an additional extension or size and shape deformations of the printed circuit board 25. In other words, if the power connecting unit 108*c* of the planar heater 108 is provided on the center of the ice maker 102 from the outer circumferential surface of the ice maker 102, the corresponding portion of the printed circuit board 25 to be electrically connected to the power connecting unit 108*c* should be extended to a center portion side of the control box 110. In this case, since the printed circuit board 25 becomes free from a formalized shape, the printed circuit board 25 should be designed separately and it is difficult to recycle the remaining raw materials after manufacturing the printed circuit board.

As a result, according to the embodiment of the present disclosure, the power connecting unit 108*c* of the planar heater 108 is provided to be biased from the center to the side of the ice maker 102 and the printed circuit board 25 is provided on a side corresponding to the power connecting unit 108*c* within the control box 110 and thus, the structure of the printed circuit board 25 can be simplified while connecting the printed circuit board 25 to the power connecting unit 108*c*, Here, it is described that the power connecting unit 108*c* is provided on the one side of the outer circumferential surface of the ice tray 102, but is not limited to. For example, it is fine as long as the power connecting unit 108*c* is just provided on the right or left around the center of the ice tray 102 from (b) of FIG. 21.

Figure 22:
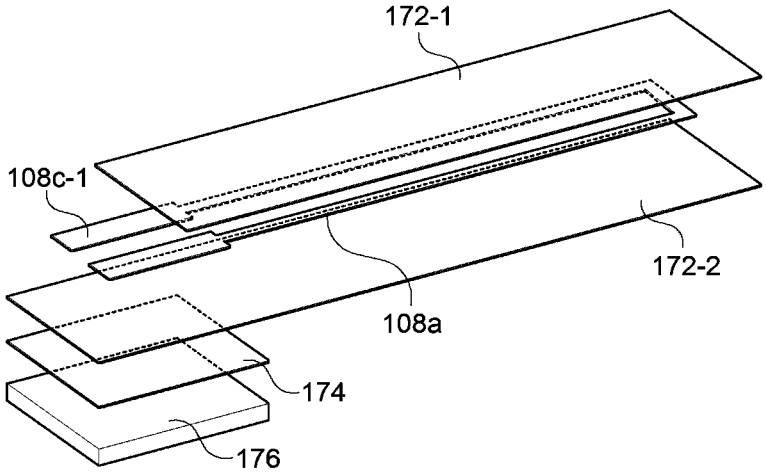
FIGS. 22 to 24 are views showing a planar heater according to still another embodiment of the present disclosure

FIG. 22 is an exploded view showing a planar heater according to another embodiment of the present disclosure Referring FIG. 22, the planar heater 108 is provided with a heating element 108*a* and an electrode pad 108*c*-1 which may be made of a metal thin film. In this case, the heating element 108*a* and the electrode pad 108*c*-1 may be integrally formed. The first insulating film 172-1 may be provided on the upper side of the heating element 108*a*. The second insulating film 172-2 may be provided on the lower sides of the heating element 108*a* and the electrode pad 108*c*-1. In other words, the first insulating film 172-1 and the second insulating film 172-2 may be provided to wrap the heating element 108*a*. In addition, the upper surface of the electrode pad 108*c*-1 is exposed to the outside. The first insulating film 172-1 and the second insulating film 172-2 may be made of polyimide materials or a PET (polyethylene phthalate).

An adhesive member 174 and a support plate 176 may be sequentially provided on the lower portion of the second insulating film 172-2 provided on the lower portion of the electrode pad 108*c*-1. The adhesive member 174 serves to be adhered to the second insulating film 172-2 and the support plate 176. Here, the power connecting unit 108*c* is made of a structure (that is, the second insulating film 172-2, the adhesive member 174 and the support plate 176) which is provided on the lower portions of the electrode pad 108*c*-1 and the electrode pad 108*c*-1. The support plate 176 serves to support the structure provided on the upper portion of the support plate 176. The support plate 176 may be made of PCB, metal PCB, plastic and the like.

Figure 23:
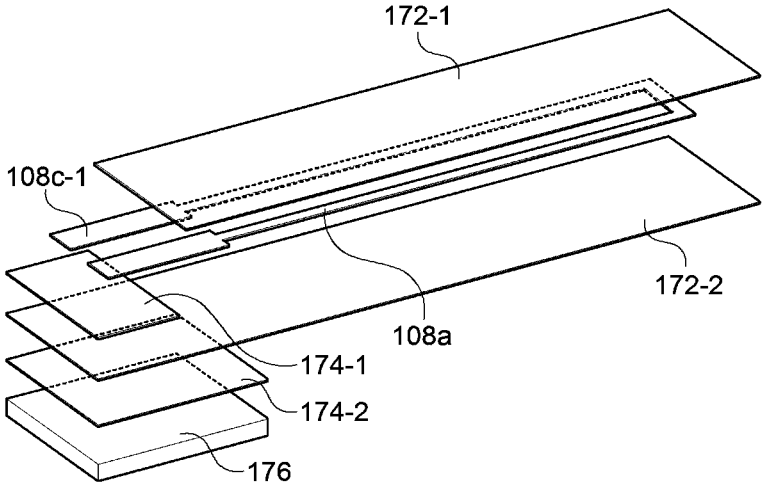

In addition, as shown in FIG. 23, the first adhesive member 174-1 is provided between the electrode pad 108*c*-1 and one surface of the second insulating film 172-2, and the second adhesive member 174-2 is provided between the other surface of the second insulating film 172-2 and the support plate 176. The electrode pad 108*c*-1 and the second insulating film 172-2 are adhered to each other by the first adhesive member 174-1 and the second insulating film 172-2 and the support plate 176 are adhered to each other by the second adhesive member 174-2.

Figure 24:
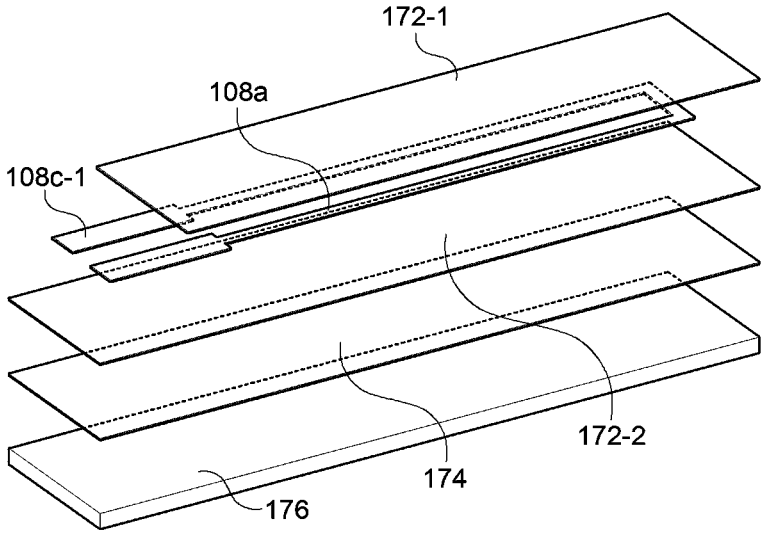

In addition, as shown in FIG. 24, the adhesive member 174 and the support plate 176 may be provided to be extended to the longitudinal direction of the planar heater 108. That is, the adhesive member 174 and the support plate 176 may be provided to be extended to the heating element 108*a* side to support the heating element 108*a*.

Figure 25:
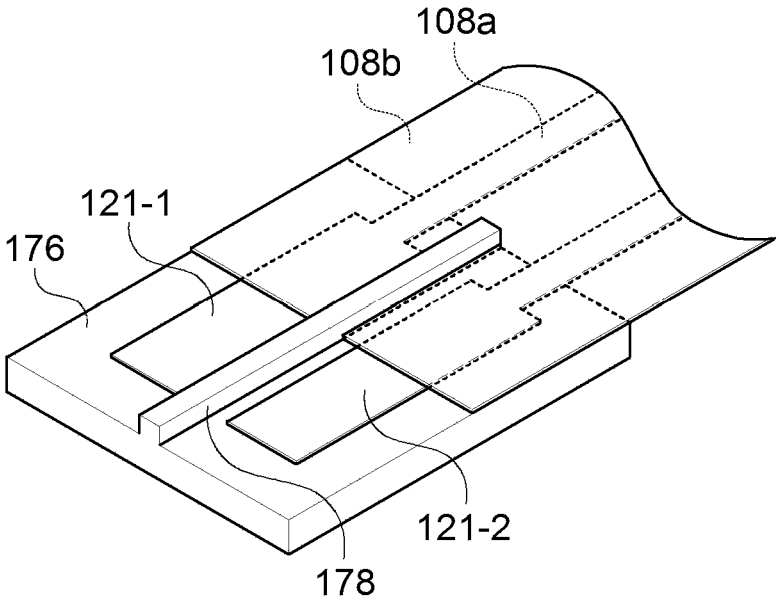
FIG. 25 is a view showing a planar heater according to yet another embodiment of the present disclosure

FIG. 25 is a view showing a planar heater according to still another embodiment of the present disclosure Referring to FIG. 25, one end of the heating element 108*a* can be connected from the upper portion of the support plate 176 to a first-1 electrode pad 121-1. The other end of the heating element 108*a* may be connected from the upper portion of the support plate 176 to a first-2 electrode pad 121-2. Here, in the support plate 176, a partitioning part 178 may be provided between the first-1 electrode pad 121-1 and the first-2 electrode pad 121-2. The partitioning part 178 may protrude from the support plate 176 and may be provided from one end to the other end of the support plate 176 along the longitudinal direction of the support plate 176, but is not limited to. For example, the partitioning part 178 may be provided in the form of a groove in the support plate 176. The partitioning part 178 serves to be electrically and physically separated (or cut off) between the first-1 electrode pad 121-1 and the first-2 electrode pad 121-2.

Figure 26:
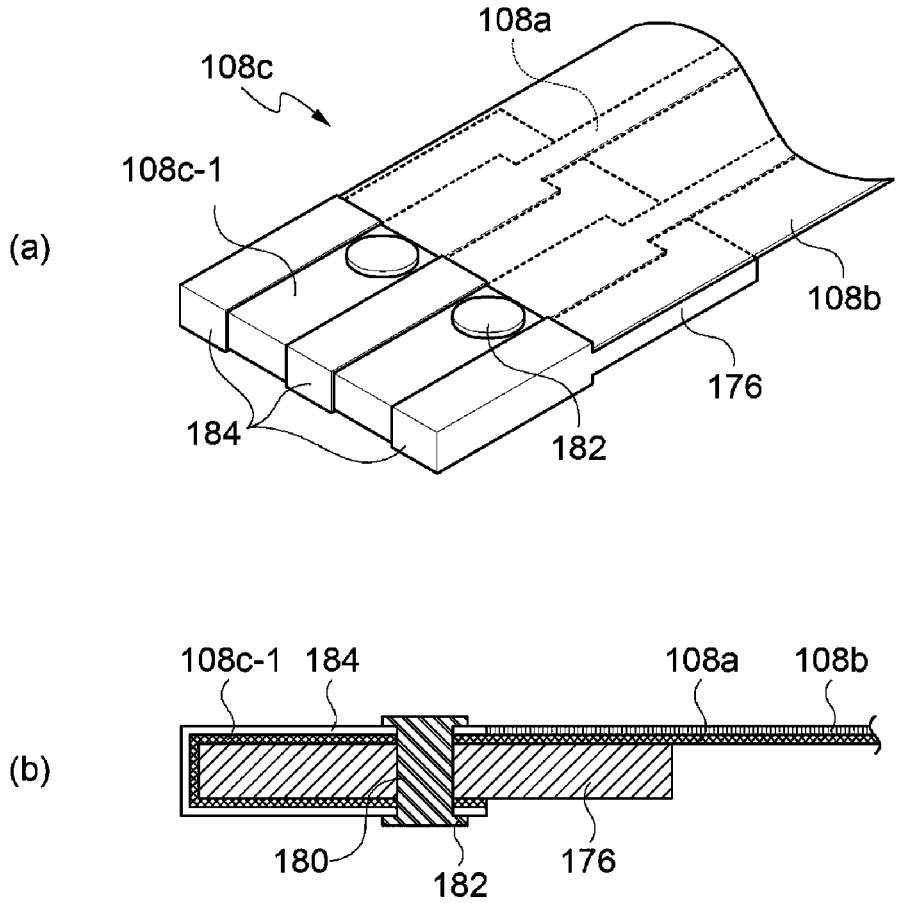
FIG. 26 is a view showing a planar heater according to yet another embodiment of the present disclosure

FIG. 26 is a view showing a planar heater according to yet another embodiment of the present disclosure. (a) of FIG. 26 is a perspective view showing the planar heater according to yet another embodiment of the present disclosure and (b) of FIG. 26 is a sectional view showing the planar heater according to yet another embodiment of the present disclosure.

Referring to FIG. 26, the electrode pad 108*c*-1 can be connected from the support plate 176 to the heating element 108*a*. The electrode pad 108*c*-1 can be provided from the upper surface of the support plate 176 to the end of the support plate 176 along the longitudinal direction of the support plate 176 (that is, a direction connected to the connector 110*a*). In addition, the electrode pad 108*c*-1 may be provided to have a predetermined length from the end of support plate 176 to the lower surface of the support plate 176. An electrode pad guide units 184 may be provided on the support plate 176 along the electrode pad 108*c*-1 from one side portion of the electrode pad 108*c*-1. The electrode pad guide unit 184 can be provided between the electrode pads 108*c*-1 and on one side portion of the electrode pad 108*c*-1. The electrode pad guide unit 184 can be provided to have a predetermined height to protrude from the surface of the support plate 176. For example, the electrode pad guide unit 184 can be provided to protrude from the surface of the support plate 176 beyond the thickness of the electrode pad 108*c*-1. The electrode pad 108*c*-1 provided on the upper surface and the lower surface of the support plate 176 can be fixed by the coupling member 182 passing through the power connecting unit 108*c*. The power connecting unit 108*c* can be provided with a through-hole 180 passing through the power connecting unit 108*c*. The through-hole 180 may be provided to pass through the electrode pad 108*c*-1 provided on the upper surface of the support plate 176 and the electrode pad 108*c*-1 provided on the lower surface of the support plate 176. The coupling member 182 can be inserted into the through-hole 180 to couple the electrode pad 108*c*-1 to the support plate 176. For the coupling member 182, rivets, bolts, eyelets, screws or the like may be used.

Figure 27:
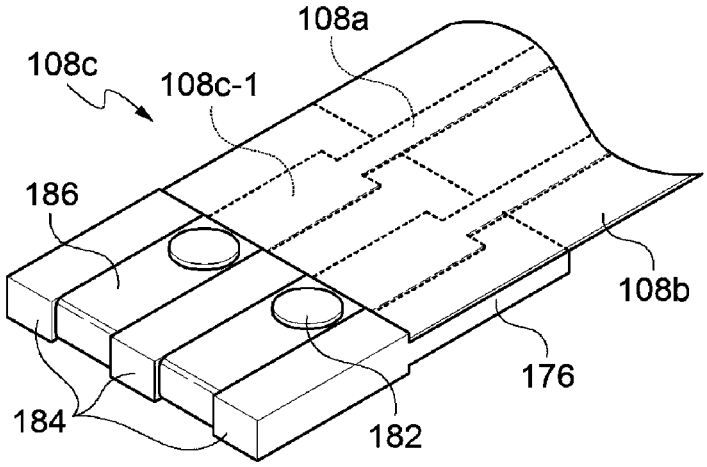
FIG. 27 is a view showing a planar heater according to yet another embodiment of the present disclosure
Figure 27:
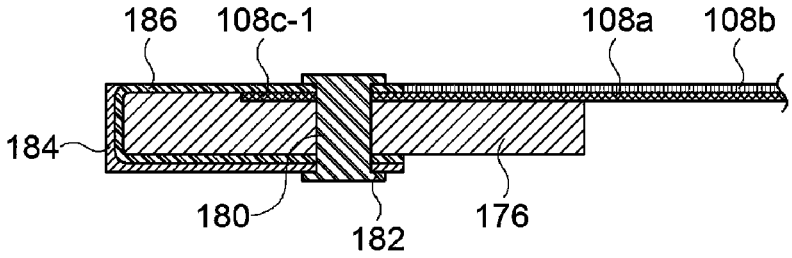

FIG. 27 is a view showing a planar heater according to yet another embodiment of the present disclosure. (a) of FIG. 27 is a perspective view showing the planar heater according to yet another embodiment of the present disclosure, and (b) of FIG. 27 is a cross-sectional view showing the planar heater according to yet another embodiment of the present disclosure. Here, it will be described only the difference in the embodiment illustrated in FIG. 26.

Referring to FIG. 27, the electrode pad 108*c*-1 can be connected to the heating element 108*a* on one side of the upper surface of the support plate 176. In addition, the metal connecting member 186 can be inserted into the end of the support plate 176 to be electrically connected to the electrode pad 108*c*-1. The metal connecting member 186 may be made of a "⊂" shape. The one end of the metal connecting member 186 is electrically connected to the electrode pad 108*c*-1 on the upper surface of the support plate 176. The metal connecting member 186 can be provided along the longitudinal direction of the support plate 176 (that is, a direction connected to the connector 110*a*) to the end of the support plate 176. In addition, the metal connecting member 186 can be provided to have a predetermined length to extend from the end of the support plate 176 to the lower surface of the support plate 176. The metal connecting members 186 can be provided to be symmetrical vertically in a state the support plate 176 is provided between the connecting members 186. The metal connecting member 186 provided on the upper surface and the lower surface of the support plate 176 can be fixed by the coupling member 182 passing through the power connecting unit 108*c*. The metal connecting member 186 can be provided to be thicker than the thin film of the pad electrode 108*c*-1. In a case where the metal connecting member 186 is connected to connected to the 110*a*, it can suppress the generated heat more effectively, compared in the case where the pad electrode 108*c*-1 of the thin film is connected to the connector 110*a*

Figure 28:
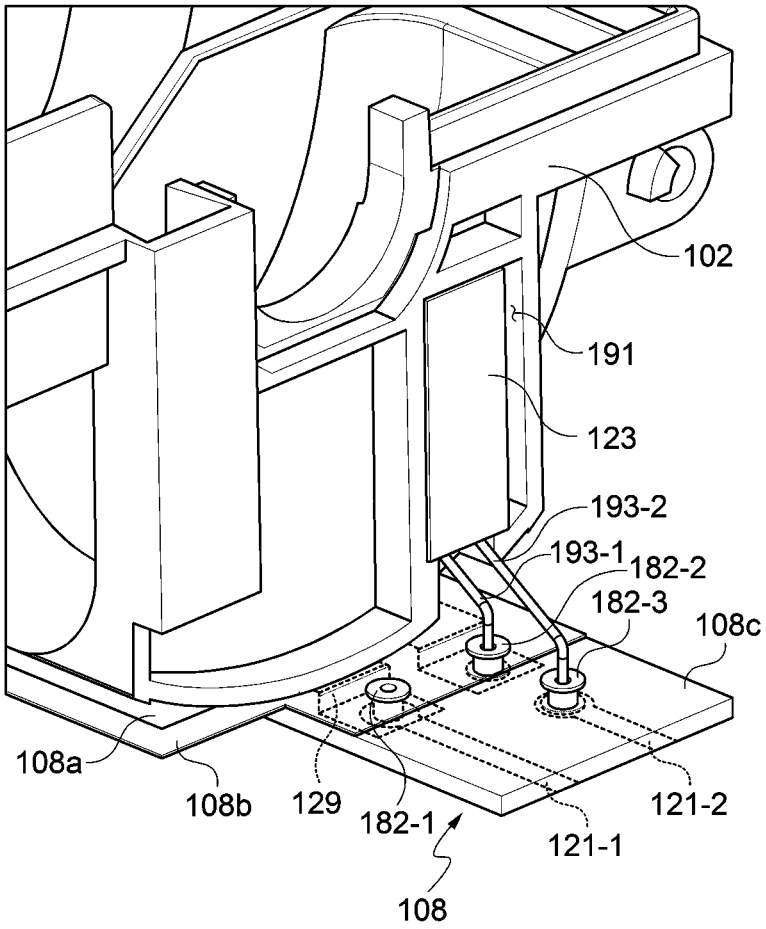
FIG. 28 is a view showing a state where a power cut-off unit is mounted into an ice tray, in an ice maker according to another embodiment of the present disclosure.

FIG. 28 is a view showing a state where a power cut-off unit is mounted into an ice tray, in the ice maker according to another embodiment of the present disclosure.

Referring to FIG. 28, a first-1 electrode pad 121-1 and a first-2 electrode pad 121-2 can be provided on the lower surface of the power connecting unit 108*c* of the planar heater 108. The heating element 108*a* of the planar heater 108 and the end of the insulating member 108*b* can be fixed to the upper surface of the power connecting unit 108*c*. In this case, the heating element 108*a* can be inserted from the upper surface of the power connecting unit 108*c* into the lower surface of the power connecting unit 108*c* through the inserting hole 129 provided on the power connecting unit 108*c*.

The one end of the heating element 108*a* can be electrically connected to the first-1 electrode pad 121-1 on the lower surface of the power connecting unit 108*c*. A portion corresponding to one end of the heating element 108*a* can be provided with the first coupling member 182-1 to pass through the power connecting unit 108*c* from the insulating member 108*b* positioned on the upper surface of the power connecting unit 108*c*. The first coupling member 182-1 serves to be electrically connected between the one end of the heating element 108*a* and the first-1 electrode pad 121-1 while fixing the insulating member 108*b* and the heating element 108*a* to the power connecting unit 108*c*.

The other end of the heating element 108*a* can be provided to be separated from the first-2 electrode pad 121-2 on the lower surface of the power connecting unit 108*c*. A portion corresponding to the other end of the heating element 108*a* can be provided with a second coupling member 182-2 to pass through the power connecting unit 108*c* form the insulating member 108*b* positioned on the upper surface of the power connecting unit 108*c*. The second coupling member 182-2 serves to fix the insulating member 108*b* and the heating element 108*a* to the power connecting unit 108*c*. The second coupling member 182-2 is in contacted with the other end of the heating element 108*a* on the lower surface of the power connecting unit 108*c*.

A portion corresponding to the first-2 electrode pad 121-2 may be provided with a third coupling member 182-3 to pass through the power connecting unit 108*c*. The third coupling member 182-3 is in contacted with the first-2 electrode pad 121-2 on the lower surface of the power connecting unit 108*c*.

On the other hand, an end surface (that is, a surface opposite to the control box) of the ice tray 102 can be provided with a receiving groove 191. In addition, the power cut-off unit 123 can be inserted and fixed to the receiving groove 191. The power cut-off unit 123 can be electrically connected to the second coupling member 182-2 by a first connecting unit 193-1. The power cut-off unit 123 can be electrically connected to a third coupling member 182-3 by a second connecting unit 193-2. In other words, the power cut-off unit 123 can be provided to be electrically connected to the other end of the heating element 108*a* and the first-2 electrode pad 121-2 by the first connecting unit 193-1 and the second connecting unit 193-2.

In a case where the power cut-off unit 123 is provided on the ice tray 102, a temperature (or a temperature of the heating element 108*a*) of the ice tray 102 is directly detected without an additional temperature sensor and, the power applied to the heating element 108*a* can be cut off if the detected temperature exceeds a predetermined temperature. In this case, the reliability of the operation of the power cut-off unit 123 can be increased. For the power cut-off unit 123, a thermal fuse, a bimetal and the like may be used. The coupling member 182-1, 182-2 and 182-3 and the heating element 108*a* and the first electrode pad (121-1, 121-2) can be connected through an arc welding, an electric welding and the like.

Here, the heating element 108*a* and the first electrode pad (121-1, 121-2) is provided on the lower surface of the power connecting unit 108*c*, and the connecting unit 193-1 and the second connecting unit 193-2 is connected to the second coupling member 182-2 and the third coupling member 182-3, respectively, but is not limited thereto. For example, the heating element 108*a* and the first electrode pad (121-1, 121-2) may be provided on the upper surface of the power connecting unit 108*c*, and the first connecting unit 193-1 and the second connecting unit 193-2 may be electrically connected to the other end of the heating element 108*a* and the first-2 electrode pad 121-2 respectively, without an additional coupling member. In this case, the first connecting unit 193-1 and the second connecting unit 193-2 can be electrically connected to the other end of the heating element 108*a* and the first-2 electrode pad 121-2, respectively, through an arc welding, an electric welding and the like. In addition, although the one end of the heating element 108*a* is electrically connected to the first-1 electrode pad 121-1 through the first coupling member 182-1, this configuration is not intended to be taken as limited thereto. For example, the one end of the heating element 108*a* may be electrically connected to the first-1 electrode pad 121-1 through an arc welding, an electric welding and the like, without an additional coupling member.

In the other hand, the first electrode pad (121-1, 121-2) can be electrically connected to the main board within the control box through a lead cable (not shown). In other words, the connector may be not included within the control box. In this case, the power connecting unit 108*c* can be electrically connected to the main board within the control box through a lead cable (not shown). The power connecting unit 108*c* can be provided to be insert-injected into a molding unit (not shown) to wrap the power connecting unit 108*c*.

Figure 29:
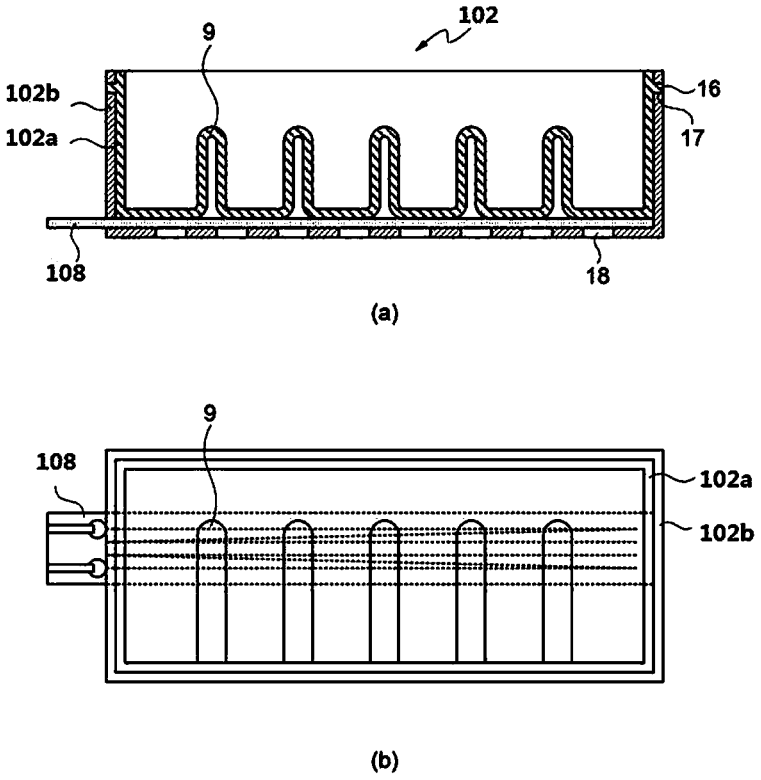
FIG. 29 is a view showing another embodiment of an ice tray, in an ice maker according to an embodiment of the present disclosure.

FIG. 29 is a schematic view showing a configuration of an ice tray 102 according to one embodiment of the present disclosure ((a) of FIG. 29 is a cross-sectional view taken along the longitudinal direction and (b) of FIG. 29 is a plan view).

Referring to FIG. 29, the ice tray 102 can include a first tray 102*a* formed of a thin metal plate and a second tray 102*b* formed of a resin. However, this configuration is not intended to be taken as limited to. For example, the first tray 102*a* may be formed of a resin and the second tray 102*b* may be formed of a thin metal plate. In addition, the first tray 102*a* and the second tray 102*b* may be all formed of a resin or a thin metal plate.

The planar heater 108 can be provided between the first tray 102*a* and the second tray 102*b*. The first tray 102*a* can be coupled to be superimposed on the inner portion of the second tray 102*b*. Such a configuration can be implemented, for example, by insert-injecting the first tray 102*a* made of a metal into a resin to form the second tray 102*b*.

The first tray 102*a* is formed, for example, by pressing (drawing) the thin metal plate having the thickness of 0.5 mm or less or can be formed by aluminum die-casting. The first tray 102*a* has a cross-section of a semi-circular and both ends of the first tray may include vertical walls. The inner space of the first tray 102*a* may be divided by a plurality of the partitions 9. The partitions 9 may be formed in a hollow shape. A hollow space of the partition 9 can be communicated with the outside of the ice tray 102 through a cut-out portion 18 formed on the second tray 102*b* to allow the cooled air to be easily transmitted to water contained in the ice tray 102 through the first tray 102*a* and thus, the freezing time can be shortened.

A protrusion 16 is formed on the outer surface of the first tray 102*a*, for example, on the outer surface of a vertical wall, and may be inserted into a groove 17 corresponding to the second tray 102*b*. In addition, shapes of the groove 17 and the protrusion 16 may be conversely formed for each other and the groove 17 and the protrusion 16 may be formed in the both trays 102*a*, 102*b*. The protrusion may have a various shapes of a cylindrical or a square pillar, a hook shape and the like, and the groove corresponding to the protrusion may have a various shapes as well. According to such a configuration, a binding force between the first tray 102*a* and second tray 102*b* can be enhanced, and the second tray 102*b* can be prevented from being separated from the first tray 102*a*. In addition, as an alternative or additionally, a concavo-convex portion may be formed on the outer surface of the first tray 102*a*. The binding force between the first tray 102*a* and second tray 102*b* can be increased by the concavo-convex portion and the second tray 102*b* can be more effectively prevented from being separated from the first tray 102*a*.

The concavo-convex portion of the outer surface of the first tray 102*a* may be formed, for example, by an embossing process or a thermal spraying process. The second tray 102*b* of the ice tray 102 can be coupled with the first tray 102*a* so as to wrap the outer surface of the first tray 102*a*, that is, so that the first tray 102*a* may be superimposed on the inner portion of the second tray 102*b*. Such a couple may be formed, for example, by insert-injecting the second tray 102*b* into the first tray 102*a*. By such a couple, even if the first tray 102*a* is formed of the thin metal plate, structural rigidity of the ice tray 102 can be maintained by the second tray 102*a*. In this case, the planar heater 108 disposed between the first tray 102*a* and the second tray 102*b* can be proceed to insert-inject into the outer surface of the first tray 102*a* in a preliminary adhered state by an adhered wrapper. By insert-injecting the second tray 102*b* into the first tray 102*a*, the groove 17 corresponding to the protrusion 16 formed on the outer surface of the first tray 102*a* is naturally provided.

In addition, second tray 102*b* can be formed with a plurality of cut-out portions 18 to expose the outer surface of the first tray 102*a*, for example, the outer surface of the bottom portion of the first tray 102*a*. The cut-out portions 18 expose the outer surface, especially the bottom portion of the first tray 102*a*, wherein the shapes and positions of the cut-out portions 18 can be variously selected. However, the cut-out portions 18 may be disposed such that a portion more requiring cooled air in the ice tray 102, for example, an outer surface of the bottom portion adjacent to the both ends can be more exposed. In addition, some cut-out portions 18 may be formed such that the hollow space of the partition 9 is communicated with the outside of the ice tray 102 to allow the cooled air to be introduced into the hollow of the partition 9. By this configuration, the cooled air can be more effectively transmitted to the water contained in the ice tray 102, thereby shortening the freezing time.

The planar heater 108 disposed between the first tray 102*a* and the second tray 102*b* can be inserted by insert-injecting the second tray 102*b* into the outer surface of the first tray 102*a*. The planar heater 108 can be disposed on a region at which the cut-out portion 18 formed on the second tray 102*b* is disposed or other region to be not exposed through the cut-out portion 18. In the other hand, the ice maker 100 may further include a heater connected to the planar heater 108 in parallel. In this case, an additional heater can be electrically connected to the planar heater 108 in parallel to be powered from the power supply unit of the planar heater 108. The additional heater can be mounted into other components (that is, components other than the ice tray 102) within the ice maker 100 or components separated from the ice maker 100.

Figure 30:
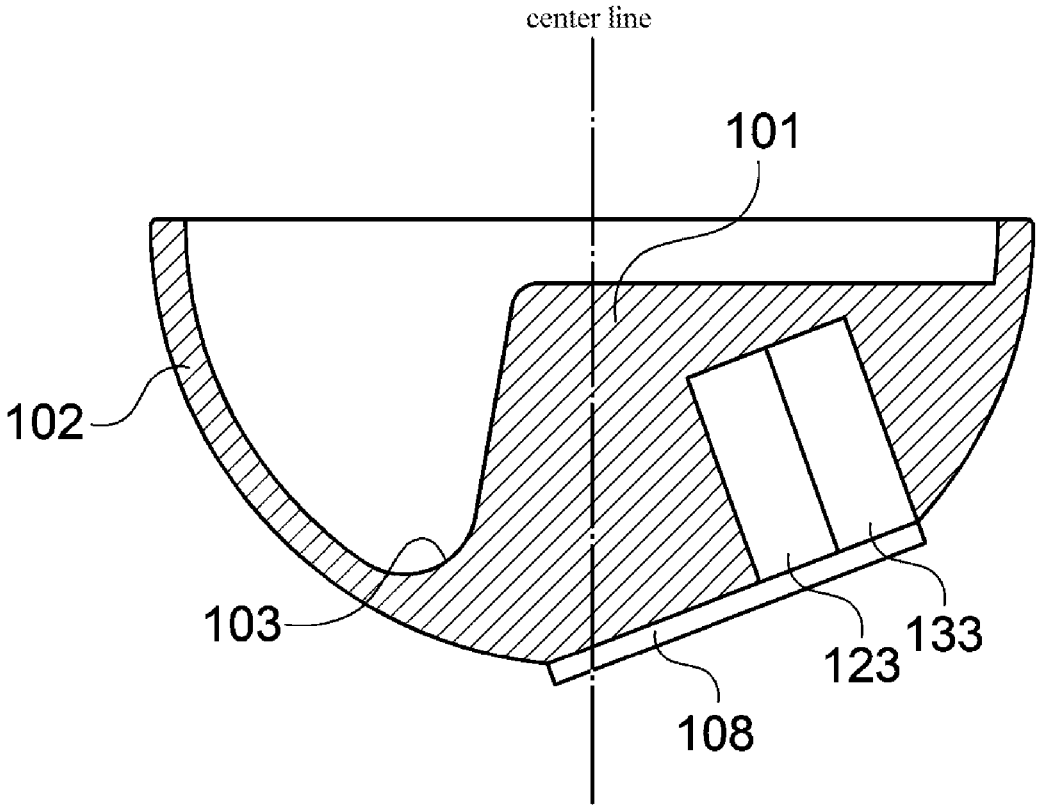
FIGS. 30 and 31 are views showing a state where a planar heater according to an embodiment of the present disclosure is mounted so as to be biased to one side from the center of the ice tray.
Figure 31:
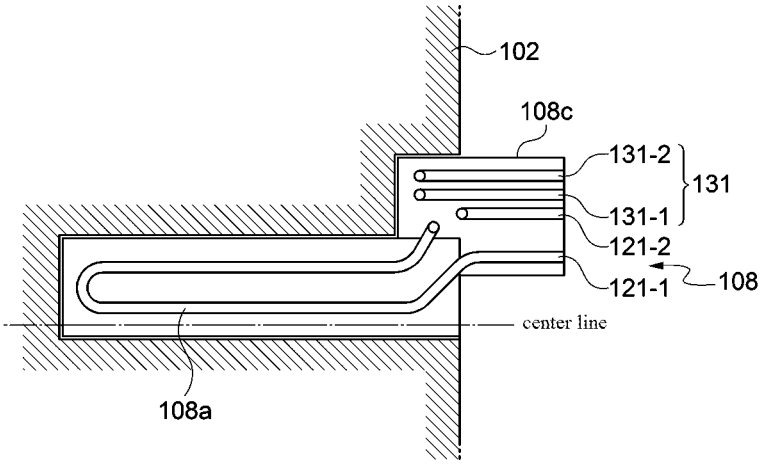

FIGS. 30 and 31 are views showing a state where a planar heater according to an embodiment of the present disclosure is mounted so as to be biased to one side from the center of the ice tray. FIG. 30 is a view showing a state viewed from the front of the ice maker according to an embodiment of the present disclosure. Here, for convenience, a portion of the ice tray 102 is shown as a cross-sectional view of the width direction of the ice tray 102. FIG. 31 is a view showing a state viewed from the bottom of the ice maker according to an embodiment of the present disclosure.

First, referring FIG. 30, the ice tray 102 may be formed with a plurality of partitions 101 therein. Each partition 101 may be formed from one side of the inner surface of the ice tray 102 toward the direction of the other side thereof. That is, each partition 101 may be provided along the width direction of the ice tray 102. In this case, each partition 101 may be provided with a movement flow path 103 of the ice-making water. When the ice-making water is supplied to the inside of the ice tray 102, in order that the ice-making water to be supplied can be received from the entire longitudinal direction of the ice tray 102, each partition 101 may be provided with the movement flow path 103 of the ice-making water.

The planar heater 108 can be provided to be biased from the bottom to one side of the ice tray 102 on the basis of the center of the ice tray 102. In this case, the planar heater 108 can be provided to be biased to a side on which the partition 101 is provided (that is, a side which is opposite to a side on which an ice-making water movement flow path 103 is provided). The planar heater 108 is provided to be biased to the side on which the partition 101 is provided to directly transmit the heat generated from the planar heater 108 to the partition 101. Accordingly, it is possible to melt the ice coupled with the surface of the partition 101. Although the whole of the planar heater 108 may be provided to be biased to one side on the basis of the center of the ice tray 102, this configuration is not intended to be taken as limited thereto. For example, the center of the planar heater 108 may be biased to one side on the basis on the center of the ice tray 102.

In addition, the power cut-off unit 123 and the temperature sensor 133 can be mounted on the end surface of the ice tray 102 (that is, a surface opposite to the control box). The power cut-off unit 123 and the temperature sensor 133 can be electrically connected to the planar heater 108, respectively. The configuration in which the power cut-off unit 123 and the temperature sensor 133 is electrically connected to planar heater 108 can be made in the same way as the manner shown in FIG. 28.

For example, the end surface of the ice tray 102 can be respectively provided with a receiving groove to which the power cut-off unit 123 and the temperature sensor 133 is received and fixed. In addition, the power cut-off unit 123 and the temperature sensor 133 are electrically connected to the planar heater 108, respectively through the connecting unit (for example, connecting units such as the reference numerals 193-1, 193-2 in FIG. 28) and the coupling member (for example, coupling members such as the reference numerals 182-1 to 182-3 in FIG. 28). Here, the power cut-off unit 123 and the temperature sensor 133 are electrically connected to the power connecting unit 108*c* of the planar heater 108.

The power cut-off unit 123 and the temperature sensor 133 can be mounted to be adjacent to each other into a portion biased from the end surface to one side of the ice tray 102 on the basis of the center of the ice tray 102. The power cut-off unit 123 and the temperature sensor 133 can be mounted to be more biased to the one side of the ice tray 102 than the planar heater 103 on the basis of the center of the ice tray 102. Thus, as the power cut-off unit 123 and the temperature sensor 133 are collectively mounted into a portion biased to the one side of the ice tray 102 on the basis of the center of the ice tray 102, it is possible to simplify the structure of the electrical connection 133 of the power cut-off unit 123 and the temperature sensor 133. With regard to this, it will be described with reference to FIG. 31 in detail.

Referring to FIG. 31, the planar heater 108 can be provided to be biased to one side of the ice tray 102 on the basis of the center of the ice tray 102. Here, the power connecting unit 108*c* provided on the end portion of the planar heater 108 can be provided to be more biased to the one side of the ice tray 102 than a body of the planar heater 108 on the basis of the center of the ice tray 102.

The power connecting unit 108*c* can be provided with the first-1 electrode pad 121-1 and the first-2 electrode pad 121-2 electrically connected to one end and the other end of the heating element 108*a*, respectively. Here, the other end of the heating element 108*a* and the first-2 electrode pad 121-2 can be connected through the power cut-off unit 123 to each other, as shown in FIG. 28. In other words, the first connecting unit 193-1 of the power cut-off unit 123 is electrically connected to the other end of the heating element 108*a* by a second coupling member 182-2, and the second connecting unit 193-2 of the power cut-off unit 123 is electrically connected to the first-2 electrode pad 121-2 by a third coupling member 182-3. Accordingly, the other end of the heating element 108*a* and the first-2 electrode pad 121-2 can be electrically connected through the power cut-off unit 123 to each other.

In addition, the power connecting unit 108*c* can be provided with the second electrode pad 131 to which the temperature sensor 133 is electrically connected. The temperature sensor 133 can measure a temperature of the ice tray 102. The temperature sensor 133 can be electrically connected to a second-1 electrode pad 131-1 and a second-2 electrode pad 131-2 through the connecting unit 193, the coupling member 182, and the like shown in FIG. 28.

Thus, as the power connecting unit 108*c* is provided to be more biased to the one side of the ice tray 102 than a body of the planar heater 108 on the basis of the center of the ice tray 102, The power cut-off unit 123 and the temperature sensor 133 can be electrically connected to the power connecting unit 108*c* and mounted to be adjacent to each other at the same time. Here, although the whole of the power connecting unit 108*c* is more biased to the one side of the ice tray 102 than a body of the planar heater 108, this configuration is not intended to be taken as limited thereto. For example, the center of the power connecting unit 108*c* may be more biased to the one side of the ice tray 102 than the center of the planar heater 108.

In the other hand, DC power (for example, 12V) can be supplied on the planar heater 108. In addition, the DC power can be also supplied on an ice-separating motor (not shown) to rotate the ejector 104. In this case, the planar heater 108 and the ice-separating motor (not shown) can be powered through one power unit.

Although a few embodiments have been described in detail, those skilled in the art will readily appreciate that many modifications are possible in embodiments without materially departing from the novel teachings and advantages. Accordingly, all such modifications are intended to be included within the scope of this inventive concept as defined in the claims.

The invention claimed is:

1. An ice maker comprising:

an ice tray having partitioned spaces receiving ice-making water;

an ejector ice-separating an ice within the ice tray;

a control box provided opposite to the ice tray and including a printed circuit board and a motor for driving the ejector therein; and a planar heater provided at the ice tray and including an heating element and an insulating member wrapping the heating element, wherein the planar heater includes a power connecting unit electrically connected to the heating element, wherein one end of the power connecting unit or a power connection line protrudes from the ice tray toward the control box, wherein one surface of the planar heater is primarily contacted with the ice tray by being bonded to the ice tray, and wherein one side of the planar heater is inserted into a connection hole of the control box with at least one of a packing member and an instrument provided at one side of the ice tray.

2. The ice maker according to claim 1, wherein the other surface of the planar heater is pressured by the instrument so that the planar heater is secondarily contacted with the ice tray.

3. The ice maker according to claim 2, wherein the instrument pressures the planar heater, and covers the planar heater.

4. The ice maker according to claim 1, wherein the instrument covers the whole planar heater.

5. The ice maker according to claim 1, wherein the one surface of the planar heater is provided opposite to the ice tray; and the ice maker further includes a heater pressuring units by which the planar heater is contacted with the ice tray by pressuring the other surface of the planar heater.

6. The ice maker according to claim 5, wherein the heater pressuring unit includes at least one pressuring protrusion which protrudes toward the planar heater side to pressure the other surface of the planar heater.

7. The ice maker according to claim 1, wherein the heating element and one side of the insulating member contacted with the ice tray at a power connecting unit of the planar heater, and the one end of the heating element is electrically connected to an electrode pad formed on the power connecting unit.

8. The ice maker according to claim 1, wherein the planar heater is provided such that portions corresponding to at least one of one end of the ice tray, the other end of the ice tray and a center portion of the ice tray are formed to have a higher heating density than the other portions.

9. The ice maker according to claim 1, wherein the planar heater is provided to be biased to one side of the ice tray on the outer circumferential surface on the basis of a center of the ice tray, and the printed circuit board of the control box is provided to be biased to a side corresponding to the planar heater on the basis of the center of the control box.

10. The ice maker according to claim 1, wherein the ice maker includes a lead cable electrically connecting the heating element and the printed circuit board, and the planar heater is provided at the ice tray and connected with the heating element and the lead cable.

11. The ice maker according to claim 10, wherein the control box includes a through-hole on a surface opposite to the ice tray, into which one end of the power connecting unit is inserted, and the ice maker further includes a packing member sealing the through-hole between the control box and the power connecting unit.

12. The ice maker according to claim 1, wherein the ice tray includes first tray formed of a metal or a resin and a second tray formed of a metal or a resin, and the first tray and the second tray are coupled with each other to be superimposed.

13. The ice maker according to claim 12, wherein the planar heater is provided between the first tray and the second tray.

14. The ice maker according to claim 12, wherein the first tray is provided on the inner side of the second tray, the second tray is made of a resin, and the planar heater is mounted on the second tray.

15. The ice maker according to claim 1, wherein a DC power is supplied according to the planar heater.

16. The ice maker according to claim 1, wherein the packing member includes an insertion into which a protector is inserted.

17. An ice maker comprising:

an ice tray having partitioned spaces receiving ice-making water;

an ejector ice-separating an ice within the ice tray;

a planar heater provided at the ice tray and including a power connecting unit having a heating element, an insulating member wrapping the heating element, and a support plate made of any one of a PCB (Printed Circuit Board), a metal PCB and plastic; and a control box provided opposite to the ice tray and include a motor for driving the ejector therein, a connector to which the power connecting unit is inserted and connected, and a printed circuit board formed with the connector, wherein the power connecting unit projecting from the planar heater is directly connected with the connecter in the control box.

18. The ice maker according to claim 17, wherein a DC power is supplied according to the planar heater.

* * * * *